US010148039B2

(12) United States Patent
Maesoba et al.

(10) Patent No.: US 10,148,039 B2
(45) Date of Patent: Dec. 4, 2018

(54) COMMUNICATION CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroyoshi Maesoba, Mie (JP); Toshifumi Ichio, Mie (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-Shi, Osaka (JP)

( * ) Notice: Subject to any disclaimer, the term of this patent is extended or adjusted under 35 U.S.C. 154(b) by 0 days.

(21) Appl. No.: 15/541,514

(22) PCT Filed: Jan. 14, 2016

(86) PCT No.: PCT/JP2016/050915
§ 371 (c)(1),
(2) Date: Jul. 5, 2017

(87) PCT Pub. No.: WO2016/121502
PCT Pub. Date: Aug. 4, 2016

(65) Prior Publication Data

US 2018/0019548 A1 Jan. 18, 2018

(30) Foreign Application Priority Data

Jan. 29, 2015 (JP) ..... 2015-015295
Mar. 11, 2015 (JP) ..... 2015-048637

(51) Int. Cl.
*H01R 4/26* (2006.01)
*H01R 13/648* (2006.01)
(Continued)

(52) U.S. Cl.
CPC ..... *H01R 13/648* (2013.01); *H01R 4/023* (2013.01); *H01R 13/6473* (2013.01); *H01R 13/6581* (2013.01); *H01R 24/60* (2013.01)

(58) Field of Classification Search
CPC ..... H01R 24/60; H01R 13/6581; H01R 13/6473; H01R 13/648; H01R 4/023
(Continued)

(56) References Cited

U.S. PATENT DOCUMENTS 4,327,956 A * 5/1982 Sitzler ..... H01R 4/245 439/397
5,120,235 A * 6/1992 Kashiwa ..... H01R 23/661 439/405
(Continued)

FOREIGN PATENT DOCUMENTS

JP 3128376 12/2006
JP 2007-123025 5/2007
(Continued)

OTHER PUBLICATIONS

International Search Report dated Apr. 19, 2016.

*Primary Examiner* — Abdullah Riyami
*Assistant Examiner* — Nelson R Burgos-Guntin
(74) *Attorney, Agent, or Firm* — Gerald E. Hespos; Michael J. Porco; Matthew T. Hespos

(57) ABSTRACT

A communication connector (10) includes a plurality of wires (12 to 15) for transmitting communication signals, a plurality of terminals (20) to be connected to the respective wires (12 to 15), a housing (30) for accommodating the plurality of terminals (20), and a wire holding member (40)
(Continued)

for arranging and holding the plurality of wires (12 to 15) at intervals.

14 Claims, 36 Drawing Sheets

(51) Int. Cl.
*H01R 13/6473* (2011.01)
*H01R 4/02* (2006.01)
*H01R 13/6581* (2011.01)
*H01R 24/60* (2011.01)

(58) Field of Classification Search
USPC ..... 439/607.23, 494, 498, 492, 395, 404
See application file for complete search history.

(56) References Cited

U.S. PATENT DOCUMENTS 5,538,440 A * 7/1996 Rodrigues ..... H01R 4/2433 439/404
5,593,315 A * 1/1997 Kinoshita ..... H01R 13/5829 439/401
6,007,371 A * 12/1999 Hickox ..... H01R 12/61 439/498
6,346,676 B1 * 2/2002 Caldwell ..... H01B 7/08 174/117 F
7,270,571 B1 * 9/2007 Huang ..... H01R 4/023 439/607.45
8,192,222 B2 * 6/2012 Kameyama ..... H01R 9/03 439/404
9,276,330 B2 * 3/2016 Wu ..... H01R 12/775
2002/0031937 A1 * 3/2002 Hagmann ..... H01R 4/2429 439/404
2005/0208823 A1 * 9/2005 Moriyama ..... H01R 13/5045 439/494
2006/0014431 A1 1/2006 Shuey et al.
2007/0099486 A1 * 5/2007 Kameyama ..... H01R 13/6477 439/498
2008/0214042 A1 * 9/2008 Kondo ..... H01R 4/027 439/466
2010/0048045 A1 * 2/2010 Tanaka ..... H01R 9/034 439/92
2011/0028026 A1 * 2/2011 Lu ..... H01R 4/2433 439/404
2015/0111416 A1 * 4/2015 Krome ..... H01R 4/2433 439/404
2015/0270659 A1 * 9/2015 Kao ..... H01R 24/64 439/607.01
2015/0311646 A1 * 10/2015 Bopp ..... H01R 13/42 439/395
2017/0256892 A1 * 9/2017 Maesoba ..... H01R 13/6589
2017/0256894 A1 * 9/2017 Maesoba ..... H01R 24/60
2018/0013239 A1 * 1/2018 Maesoba ..... H01R 13/648
2018/0019547 A1 * 1/2018 Maesoba ..... H01R 13/648
2018/0019548 A1 * 1/2018 Maesoba ..... H01R 13/648

FOREIGN PATENT DOCUMENTS

JP 2008-507110 3/2008
JP 2008-218149 9/2008
JP 2010-49961 3/2010

* cited by examiner

COMMUNICATION CONNECTOR

BACKGROUND

1. Field of the Invention

The invention relates to a communication connector.

2. Description of the Related Art

Communication connectors are well known. For example, Japanese Unexamined Patent Publication No. 2008-507110 discloses an electrical connector capable of receiving four USB plug connectors. This electrical connector includes a housing, electrical contacts bent into an L shape and made of metal, an outer shield and an inner shield. Electrical contacts are arranged laterally and fixed for each USB plug connector.

In the case of using wires instead of metal bars as conductors, intervals between wires may change at some positions since the wires are deflected easily. Such positions where the intervals between the wires largely change may serve as impedance changing points of the wires and cause the reflection of signals to reduce communication quality.

The present invention was completed in view of the above situation and aims to suppress a reduction of communication quality.

SUMMARY

The invention is directed to a communication connector with wires for transmitting communication signals, terminals to be connected to the respective wires, a housing for accommodating the terminals, and a wire holding member for arranging and holding the wires at intervals.

According to this configuration, the wire holding member arranges and holds the wires at intervals, thereby reducing positions where intervals between the wires can change significantly. In this way, a reduction of communication quality due to the reflection of signals and the like at impedance changing points of the wires can be suppressed.

The wire holding member includes grooves for pinching and holding the respective wires. In this way, a wire mounting operation can be performed easily while simplifying a configuration for holding the wires. A shield case is provided and includes a body for covering the housing and an extending portion extending toward the wire holding member, and the wire holding member includes a restricting portion for restricting a moving direction with respect to the shield case by being engaged with the extending portion. In this way, the wire holding member can be held at a predetermined position by using the restricting portion to restrict the moving direction of the wire holding member with respect to the shield case by.

A shielded cable is provided and includes the wires, a filled member to be filled around the wires and a shield layer enclosing the filled member. The wire holding member holds the wires exposed from an end part of the filled member and includes an inserting protrusion to be inserted into the end part of the filled member. In this way, the wire holding member can be held in position with respect to the shielded cable by inserting the inserting protrusion into the end part of the filled member.

Two of the wire holding members may be provided and may be formed with penetrating wire insertion holes through which the wires are to be inserted. Additionally, the wire holding members may be formed with through grooves enabling the wires to be passed laterally with respect to an axial direction of the wire insertion holes. In this way, the wires inserted into the wire insertion holes through the through grooves laterally with respect to the axial direction of the wire insertion holes can be held by the wire holding members. Thus, for example, an operation of removing coatings of insulated wires and an operation of mounting the wires into the housing can be performed easily with the wires held by the wire holding members so that assembling operability can be improved.

First and second wire rows composed of the wires are provided, and the wire holding member holds the first and second wire rows in parallel. Thus, a space can be utilized effectively and the communication connector can be miniaturized.

The wires may include first communication wires, a second communication wire having a lower transfer speed than the first communication wires and a power supply wire connected to a power supply. The wire holding member may include a partitioning portion for partitioning between the first communication wires or between the first communication wire and the power supply wire.

The housing may include a plurality of cavities for accommodating the respective terminals and is mounted in a vehicle. There is a concern that vibrations in a vehicle can cause intervals between the wires to vary and can cause troubles, such as a reduction of communication quality. The wire holding member arranges and holds the wires at intervals as in the above configuration, whereby the intervals between the wires are held even if the vibration of the vehicle or the like occurs. Thus, troubles such as a reduction of communication quality due to the vibration of the vehicle can be suppressed.

DETAILED DESCRIPTION

Figure 7:
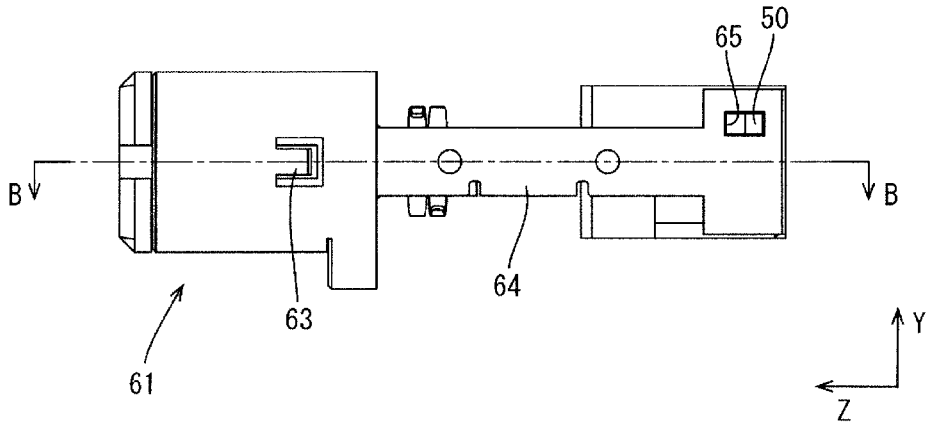
FIG. 7 is a side view showing the communication connector in the state where the second shield case and the shielded cable are removed.

A first embodiment is described with reference to FIGS. 1 to 16. A communication connector 10 is mounted in a vehicle such as an electric or hybrid vehicle and, for example, is arranged in a wired communication path between an in-vehicle electrical component (navigation system, ETC, monitor or the like) and an external device (camera or the like) or between in-vehicle electrical components in a vehicle. In the following description, a left side and a right side of FIG. 3 are referred to as a front side and a rear side concerning a front-rear direction (Z axis), an upper side and a lower side of FIG. 3 are referred to as a left side and a right side concerning a lateral direction (X axis) and a vertical direction (Y axis) is based on a direction of FIG. 7.

(Communication Connector 10)

Figure 1:
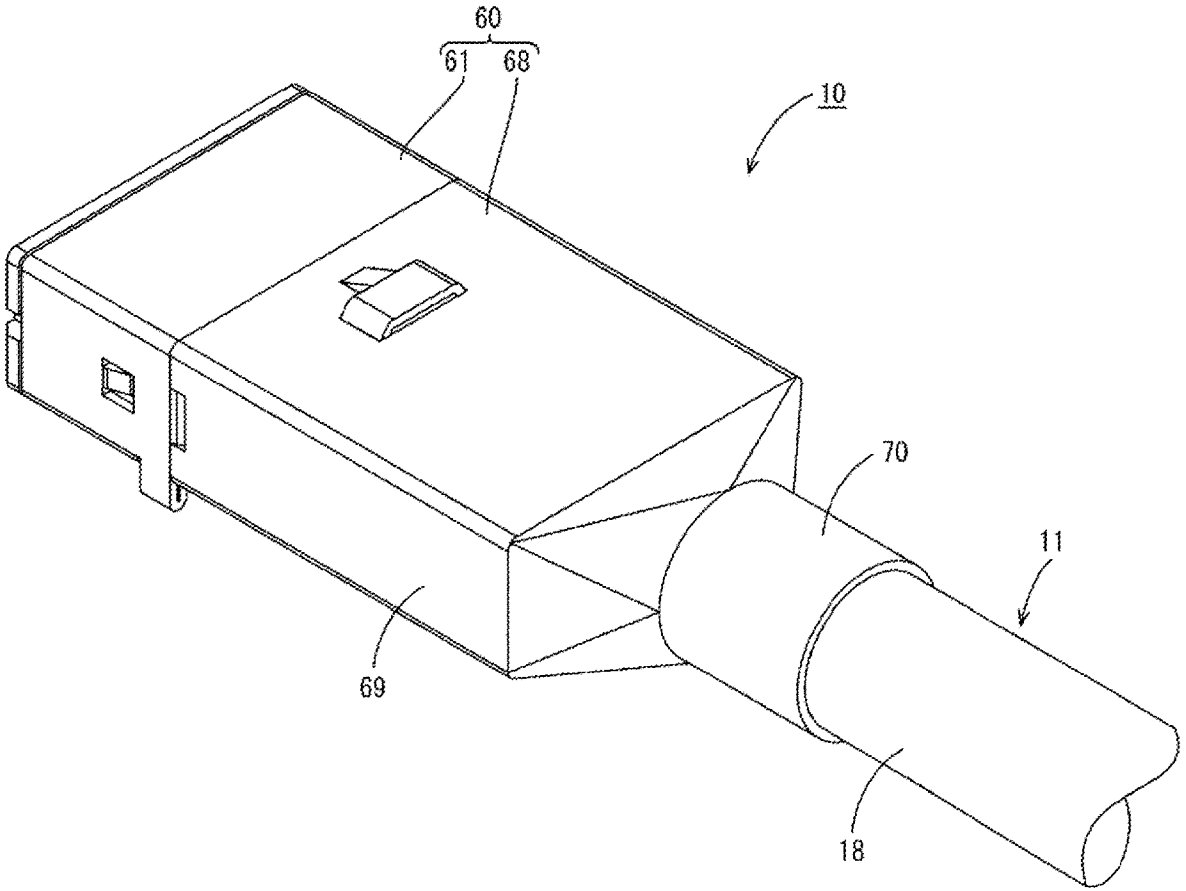
FIG. 1 is a perspective view showing a communication connector of a first embodiment.
Figure 2:
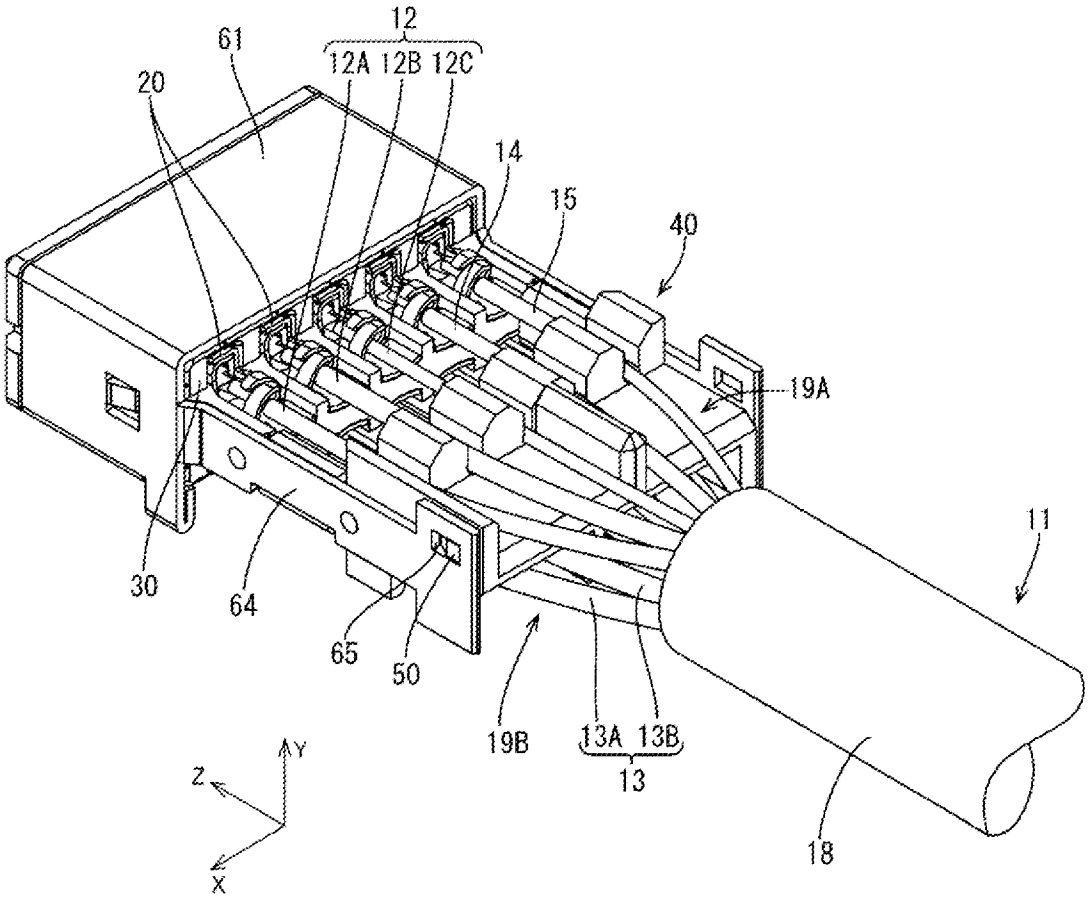
FIG. 2 is a perspective view showing the communication connector in a state where a second shield case is removed.
Figure 3:
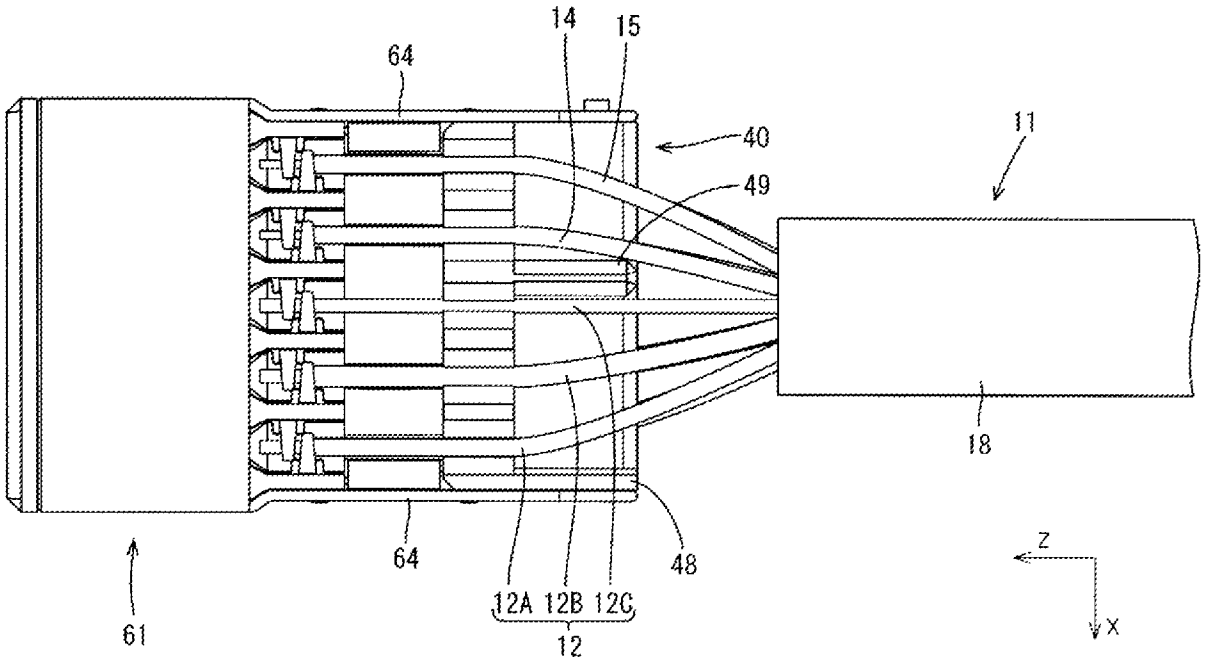
FIG. 3 is a plan view showing the communication connector in the state where the second shield case is removed.

The communication connector 10 of the first embodiment includes, as shown in FIGS. 1 and 2, a shielded cable 11 having wires 12 to 15, terminals 20 connected to end parts of the respective wires 12 to 15, a housing 30 for accommodating the terminals 20, a wire holding member 40 arranged behind the housing 30, and a shield case 60 for covering the housing 30 and the wire holding member 40.

(Shielded Cable 11)

The shielded cable 11 is capable of high speed communication of 1 GHz or faster and includes the wires 12 to 15 (ten wires in this embodiment) for transmitting communication signals, a shield layer 16 (see FIG. 23) collectively enclosing the wires 12 to 15, a filled member 17 filled between the wires 12 to 15 and the shield layer 16, and an insulation coating 18 covering the outer periphery of the shield layer 16.

The wires 12 are two sets of high-speed cables (differential pair cables with a shield and a drain wire) 12A to 12C as first communication wires and are wires of USB (Universal Serial Bus) 3.0 standard in this embodiment. The wires 13 include two wires 13A, 13B that define a twisted pair cable without a shield for second communication. The wires 13A, 13B have a lower maximum data transfer speed than the first communication wires and are wires of USB 2.0 standard in this embodiment. The wire 14 is one power supply wire to be connected to a power supply and the wire 15 is one ground wire connected to ground.

Each wire 12 to 15 has a metal wire coated with an insulation layer made of insulating synthetic resin and has a different thickness (outer diameter) according to the type of the wire. The shield layer 16 is a braided wire formed by braiding thin metal wires. The filled member 17 is formed by packing insulating threads, paper tape or the like between the wires 12 to 15 and the shield layer 16. The filled member 17 holds the wires 12 to 15 in position by filling up clearances between the wires 12 to 15 and the shield layer 16 and suppresses deformation, such as deflection of the wires 12 to 15. The insulation coating 18 is made of insulating synthetic resin.

The wires 12 to 15 are composed of a first wire row 19A in which five wires are arranged laterally in a row and a second wire row 19B in which five wires are arranged laterally in a row below and in parallel to the first wire row 19A. The leading end parts of the ten wires 12 to 15 of the shielded cable 11 exposed from an end surface of the filled member 17 have the insulation coatings removed to expose the conductors to be connected to the terminals 20.

(Terminals 20)

Figure 4:
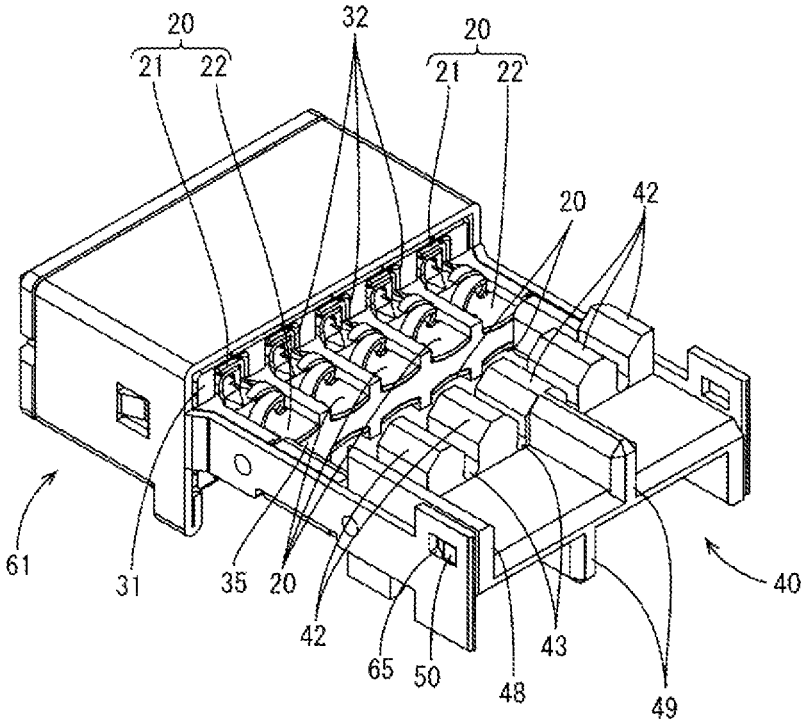
FIG. 4 is a perspective view showing the communication connector in a state where the second shield case and a shielded cable are removed.
Figure 5:
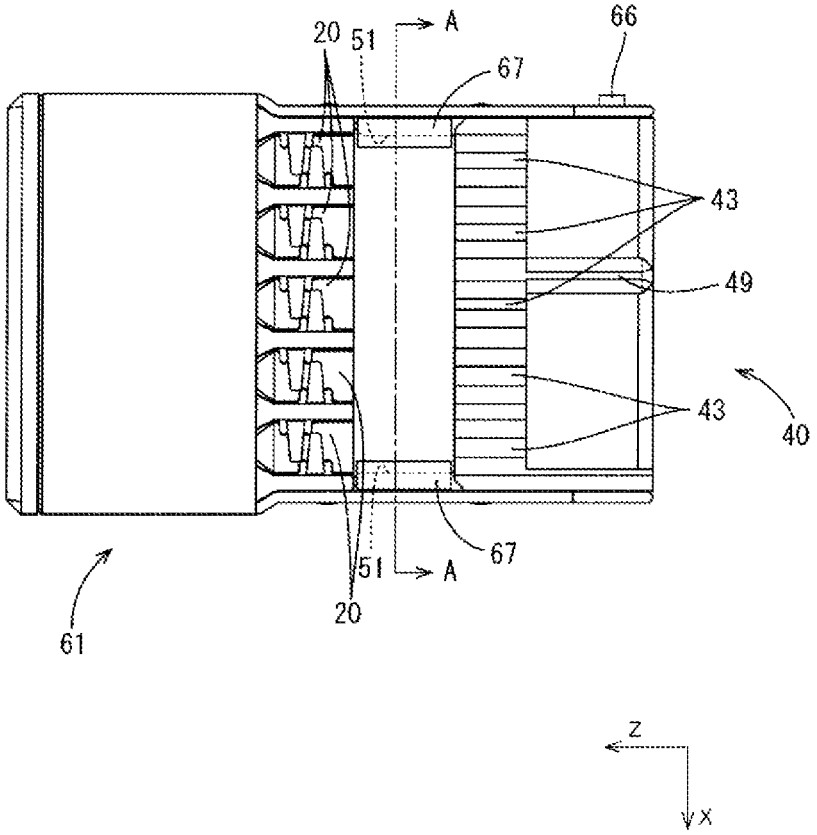
FIG. 5 is a plan view showing the communication connector in the state where the second shield case and the shielded cable are removed.
Figure 6:
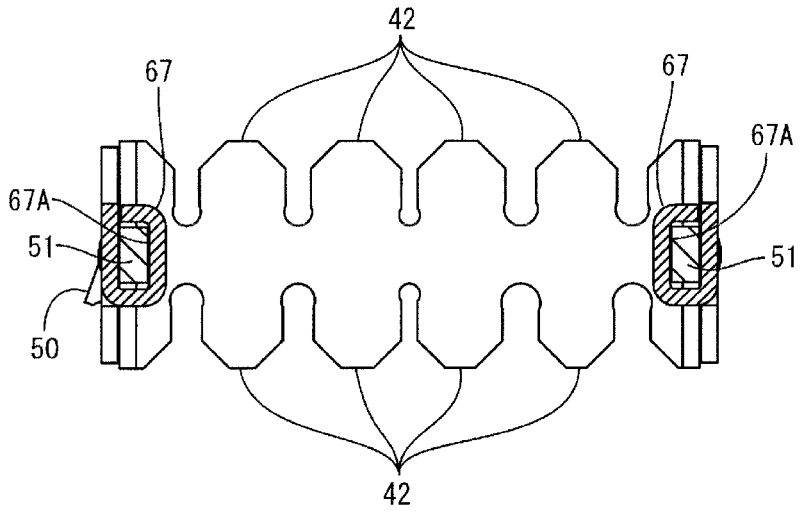
FIG. 6 is a section along A-A of FIG. 5.

As shown in FIG. 4, a front end of the terminal 20 serves as a terminal connecting portion 21 in the form of a rectangular tube, and a wire connecting portion 22 to be connected to the conductor of the wire 12 to 15 is formed integrally on a rear end of the terminal connecting portion 21. The terminal connecting portion 21 has a resilient contact piece (not shown) to be connected to a mating male terminal. The wire connecting portion 22 includes a bottom plate and two barrel pieces respectively folded and extending from both side edges of the bottom plate. The conductor exposed from the end part of the wire 12 to 15 is connected electrically to the wire connecting portion 22 such as by being soldered or welded to the bottom plate.

(Housing 30)

Figure 10:
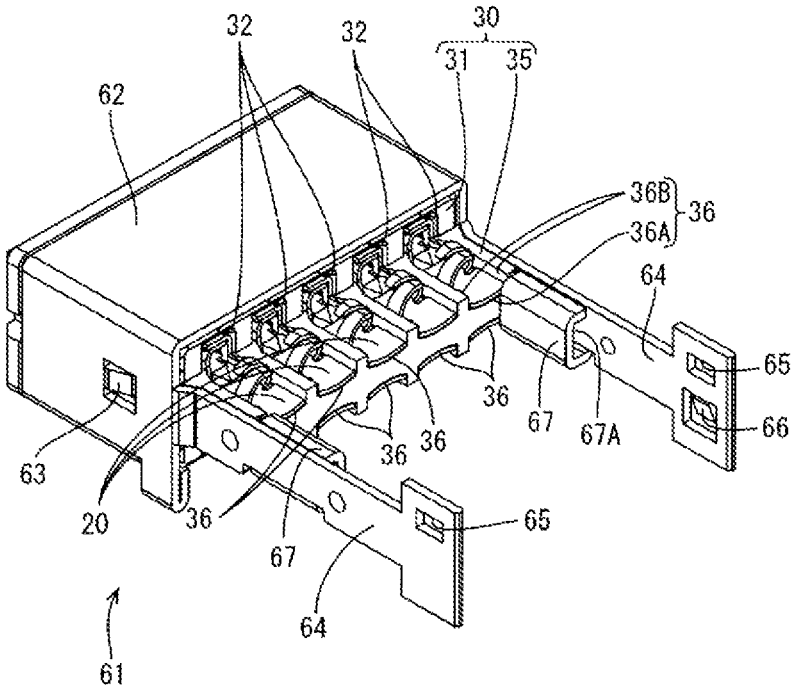
FIG. 10 is a perspective view showing a state where a housing and terminals are mounted in a first shield case.
Figure 11:
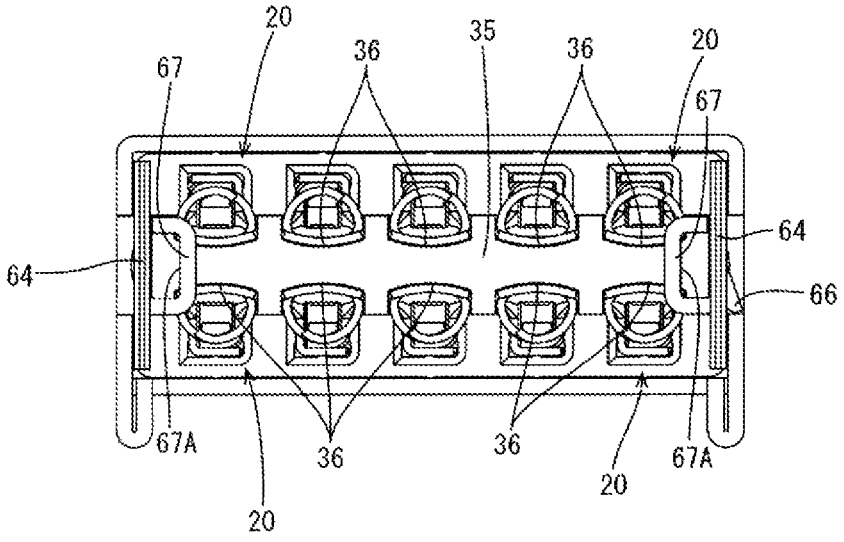
FIG. 11 is a back view showing the state where the housing and the terminals are mounted in the first shield case.

The housing 30 is made of insulating synthetic resin and includes, as shown in FIG. 10, a body 31 for accommodating the terminal connecting portions 21 of the respective terminals 20 and a housing extending portion 35 extending rearward behind the body 31 with upper and lower surface sides of the body 31 cut off. The body 31 has a rectangular parallelepiped shape and five cavities 32 for accommodating the terminals 20 are arranged laterally in each of two upper and lower stages. Each cavity 32 has a rectangular cross-section and extends in the front-rear direction according to a length of the terminal connecting portion 21. A front stop wall (not shown) for restricting a forward movement of the terminal 20 is formed on a front end part of the cavity 32. A deflectable and deformable locking lance (not shown) is cantilevered forward at an inner wall of the cavity 32 for restricting rearward withdrawal of the terminal 20 by locking the terminal connecting portion 21.

The housing extending portion 35 is in the form of a plate extending rearward from a vertically middle part on the rear end of the body 31 and includes groove-like placing portions 36 arranged such that the wire connecting portions 22 of the respective terminals 20 can be placed thereon. The placing portions 36 are formed laterally side by side according to the number of the terminals 20 on each of the upper surface and the bottom surface of the housing extending portion 35 and each have a bottom surface 36A on which the bottom plate of the terminal 20 is to be placed and groove walls 36B standing up from both side edges of the bottom surface 36A. The bottom surface 36A is slightly curved so that a middle side is lower. The groove walls 36B are connected obliquely to the cavity 32 to narrow the bottom surface 36A toward a front side.

(Wire Holding Member 40)

Figure 12:
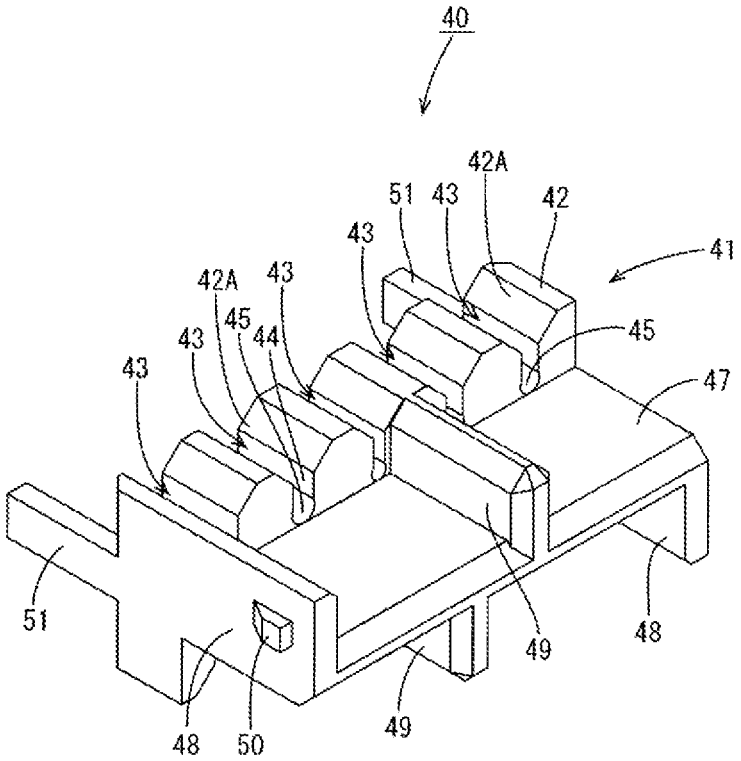
FIG. 12 is a perspective view showing a wire holding member.
Figure 13:
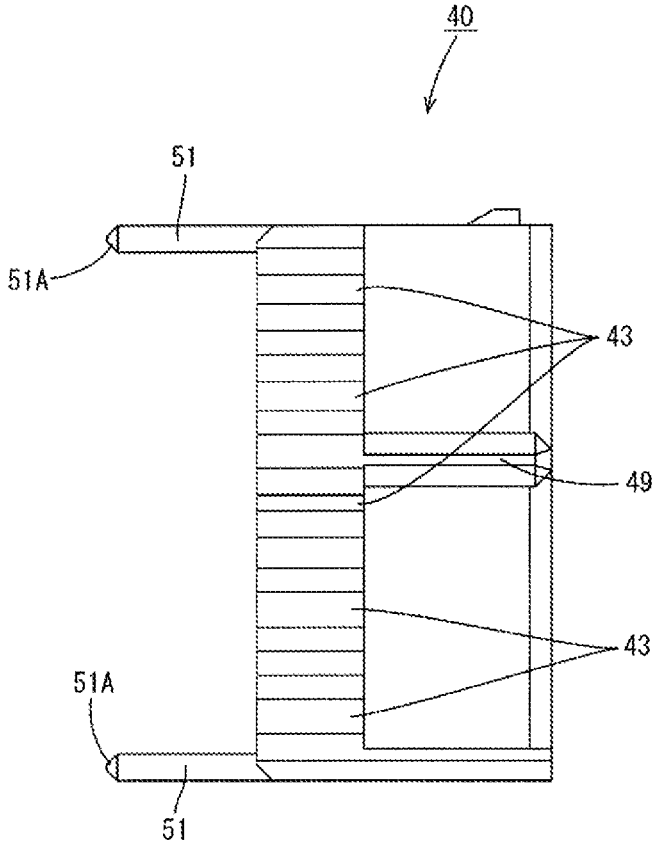
FIG. 13 is a bottom view showing the wire holding member.
Figure 14:
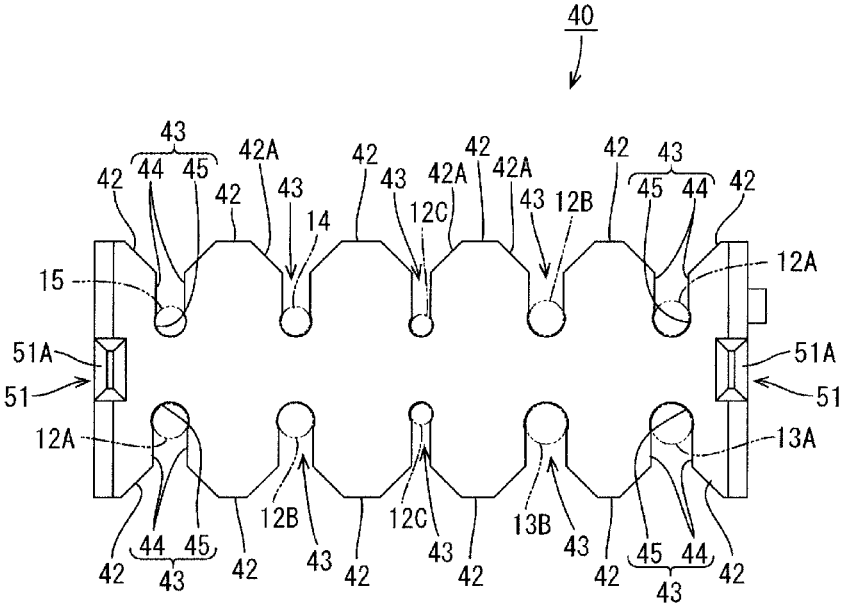
FIG. 14 is a front view showing the wire holding member.
Figure 15:
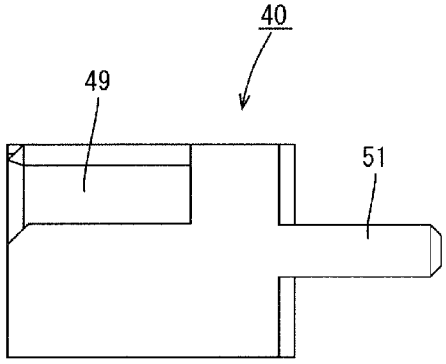
FIG. 15 is a left side view showing the wire holding member.

The wire holding member 40 is made of synthetic resin and arranged at an interval (clearance) from the rear end of the housing extending portion 35 and includes, as shown in FIGS. 12 and 14, a wire holding portion 41 for arranging and holding the wires 12 to 15. A partitioning plate integrally is connected behind the wire holding portion 41 and is configured to partition between the upper and lower wire rows 19A, 19B. Standing walls 48, 49 stand up and down from the partitioning plate 47, and restricting portions 51 project forward from both end parts of the wire holding portion 41. The restricting portions 51 are configured to restrict movements in directions other than the front-rear direction with respect to the shield case 60, as shown in FIGS. 12 and 14.

The wire holding portion 41 includes holding protrusions 42 that project on each of upper and lower surfaces and are arranged laterally in a row at intervals. An interval between adjacent holding protrusions 42 defines a groove 43 for pinching and holding the wire 12 to 15. The groove 43 includes two groove walls 44 that are side surfaces of the adjacent holding protrusions 42, and an arcuate wire accommodating portion 45 connecting back end sides of the groove walls 44. The holding protrusion 42 is formed with two guides 42A in the form of inclined surfaces formed by cutting a tip side of the holding protrusion 42. The guides 42A guide the insertion of the wire 12 to 15.

A width of the groove 43 is set such that a part of the corresponding wire 12 to 15 including the insulation coating 18 is insertable by press fitting and differs depending on a thickness of the wire 12 to 15 to be inserted. The grooves 43 are arranged at positions in the lateral direction so that the intervals between the laterally adjacent wires 12 to 15 held in the grooves 43 (intervals between center axes of the wires) are equal. The wire accommodating portion 45 has an inner diameter to be held in close contact with the outer periphery of the wire 12 to 15 to be accommodated therein.

The partitioning plate 47 is long in the lateral direction and the upper and lower surfaces thereof are arranged at such heights as to be connected to lowest back ends of the wire accommodating portions 45. Standing walls 48 and 49 are provided on the upper and lower surfaces of the partitioning plate 47 The standing wall 48 stands up from a left end part and the standing wall 49 (an example of the "partitioning portion") is arranged to the right of a laterally middle part. The standing wall 48 standing down from a right end part and the standing wall 49 arranged to the left of the laterally middle part are provided on the lower surface side of the partitioning plate 47. A locking projection 50 projects on an outer surface of the left standing wall 48. The locking projection 50 is a step-like projection on a rear end, has an inclined surface on a front side and is locked to an edge of a locking hole 65 of the shield case 60.

Figure 16:
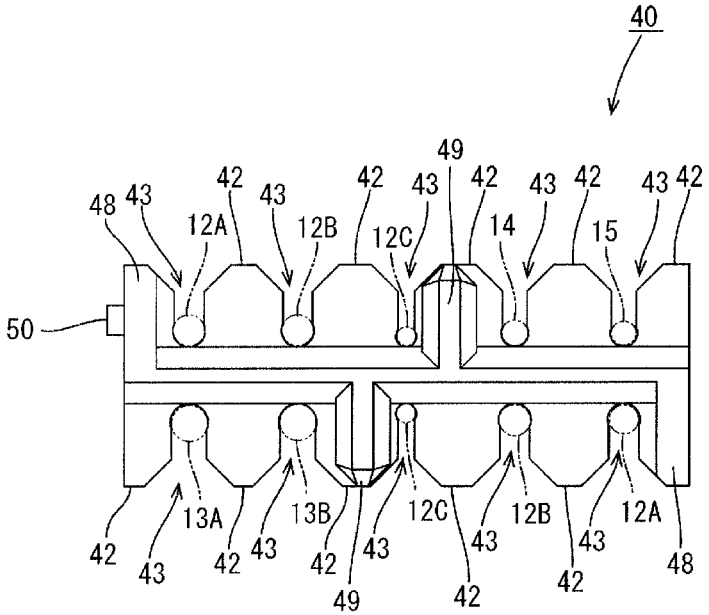
FIG. 16 is a back view showing the wire holding member.

The restricting portion 51 is a rectangular plate extending in the front-rear direction, projects forwardly of the wire holding portion 41 along an outer side surface of the standing wall 48 and extends straight forward from a vertically middle part of the standing wall 48. A tip part of the restricting portion 51 is formed with a tapered portion 51A tapered by cutting the outer periphery of this tip part. As shown in FIG. 16, three wires 12A to 12C are inserted at intervals between the standing walls 48 and 49 on each of the upper and lower sides of the partitioning plate 47 in the wire holding member 40. In this way, the upper and lower wires 12A to 12C are arranged at mutually orthogonal positions (areas at distant sides).

(Shield Case 60)

The shield case 60 is made of metal, such as aluminum or aluminum alloy, and includes, as shown in FIG. 1, a first shield case 61 for covering the body 31 of the housing 30 and a second shield case 68 arranged behind the first shield case 61 for covering the wires 12 to 15. As shown in FIG. 10, the first shield case 61 includes a housing enclosing portion 62 in the form of a rectangular tube for enclosing the housing 30 and left and right shield extending portions 64 extending rearward. Resiliently deformable locked pieces 63 are provided on left and right side surfaces of the housing enclosing portion 62. When the housing 30 is inserted and fit from the front of the first shield case 61, the locked pieces 63 are locked to locking portions 33 formed by cutting the side surfaces of the housing 30 to have step-like front sides (see FIG. 8).

The shield extending portions 64 are plates extending rearward from the rear ends of the side surface parts of the housing enclosing portion 62, and include the rectangular penetrating locking holes 65 and connecting pieces 66 configured to contact the inner surface of the second shield case 68. The connecting pieces 66 are resiliently deformable by cutting the shield extending portions 64 and electrically connect the first and second shield cases 61, 68.

Figure 8:
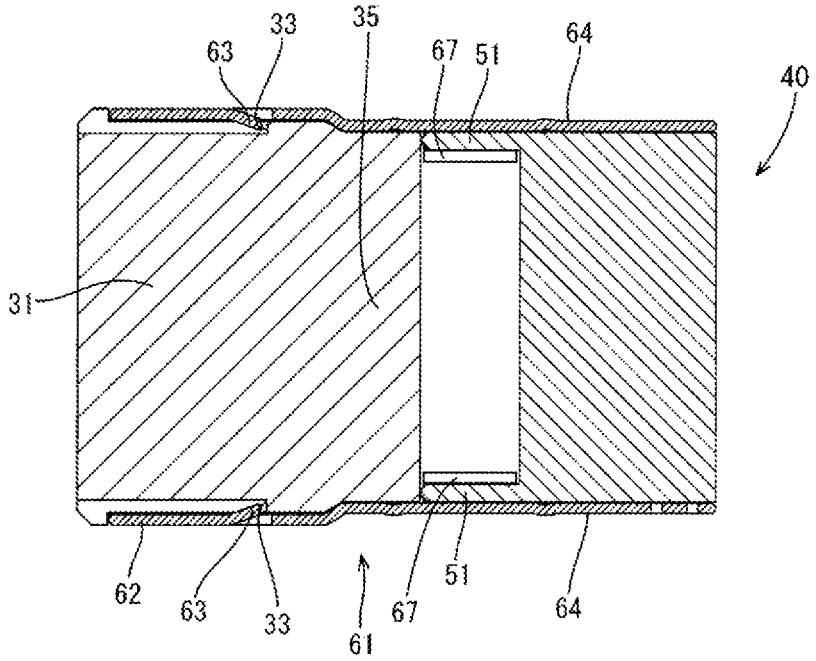
FIG. 8 is a section along B-B of FIG. 7.
Figure 9:
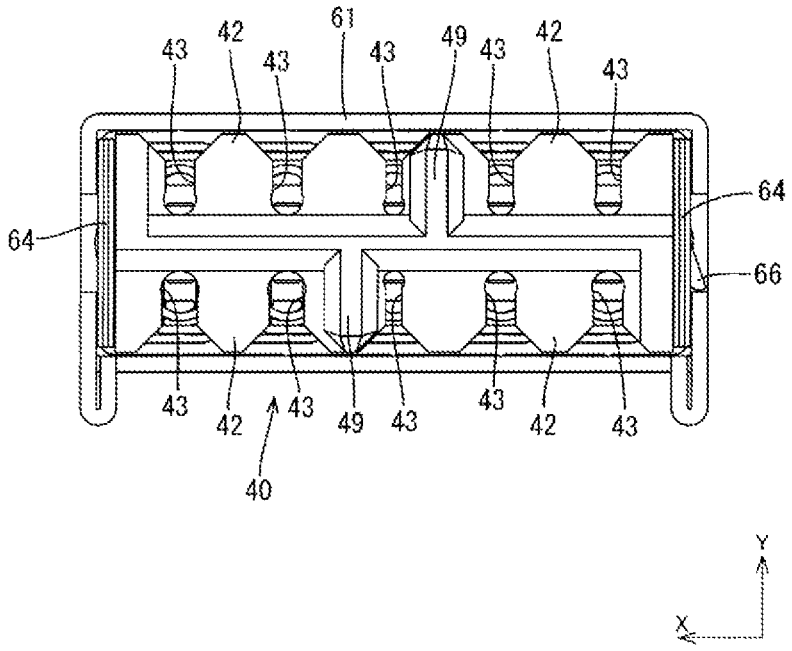
FIG. 9 is a back view showing the communication connector in the state where the second shield case and the shielded cable are removed.

Tubular portions 67 are formed on inner sides of the shield extending portions 64. Each tubular portion 67 is a rectangular tube formed in an intermediate part of the shield extending portion 64 in the front-rear direction, and a rectangular insertion hole 67A penetrates in the front-rear direction. With the housing 30 inserted to a proper position in the first shield case 61, the tubular portions 67 are connected behind the housing extending portion 35. As shown in FIG. 8, the tubular portions 67 are engaged with the restricting portions 51 to restrict movements of the wire holding portion 41 in the directions other than the front-rear direction by having the restricting portions 51 of the wire holding member 40 inserted therein. Further, the leading ends of the restricting portions 51 are held in contact with the rear end of the housing extending portion 35 to restrict a forward movement of the wire holding member 40. A clearance of a length of the tubular portions 67 is formed between the housing extending portion 35 and the wire holding member 40. Further, as shown in FIG. 4, the locking projection 50 of the wire holding member 40 is locked to the edge of the locking hole 65 to restrict a rearward movement of the wire holding member 40. Specifically, the wire holding member 40 is positioned in the front-rear direction by the housing 30 and the second shield case 68.

The second shield case 68 is made of metal, such as aluminum or aluminum alloy, and includes, as shown in FIG. 1, a box-shaped wire shielding portion 69 open on a front side and a hollow cylindrical shield connecting portion 70 to be fit on the shielded cable 11. The wire shielding portion 69 encloses the wires 12 to 15 and the wire holding member 40. The shield connecting portion 70 is, for example, connected to the shield layer 16 folded outwardly of the insulation coating 18 on the end part of the shielded cable 11. The shield connecting portion 70 and the shield layer 16 can be fixed, for example, by welding, crimping or the like. Further, the shield layer 16 may be sandwiched between a hollow cylindrical collar made of metal (not shown) and the shield connecting portion 70.

According to this embodiment, the following effects and functions are exhibited.

Since the wire holding members 40 arranges and holds the wires 12 to 15 at intervals, positions where the intervals between the wires 12 to 15 change can be reduced. This can suppress a reduction of communication quality due to the reflection of signals and the like at impedance changing points of the wires 12 to 15.

Further, the wire holding member 40 includes the grooves 43 for pinching and holding the respective wires 12 to 15. In this way, it is possible to easily perform an operation of mounting the wires 12 to 15 while simplifying the configuration for holding the wires 12 to 15.

Further, the shield case 60 includes the body 31 for covering the housing 30 and the shield extending portions 64 extending toward the wire holding member 40. The wire holding member 40 includes the restricting portions 51 for restricting a moving direction with respect to the shield case 60 by being engaged with the shield extending portions 64. In this way, the wire holding member 40 easily is held at a predetermined position by having the restricting portions 51 restrict the moving direction of the wire holding member 40 with respect to the shield case 60.

Further, the first wire row 19A composed of the wires 12 to 15 and the second wire row 19B composed of the wires 12 to 15 are provided, and the wire holding member 40 holds the first and second wire rows 19A, 19B in parallel. Since the wire holding member 40 holds the first and second wire rows 19A, 19B in parallel in this way, a space can be utilized effectively and the communication connector 10 can be miniaturized.

The housing 30 includes the cavities 32 for accommodating the respective terminals 20 and is mounted in the vehicle. Mounting the communication connector 10 in a vehicle can cause the intervals between the wires 12 to 15 to vary due to the vibration of the vehicle and can cause troubles such as a reduction of communication quality. The wire holding member 40 arranges and holds the wires 12 to 15 at intervals in the above-described embodiment so that the intervals between the wires 12 to 15 are held even if the vibration of the vehicle or the like occurs. Thus, troubles such as a reduction of communication quality due to the vibration of the vehicle can be suppressed.

A second embodiment is described with reference to FIGS. 17 to 28.

A communication connector 80 of the second embodiment is not provided with the restricting portions 51 of the wire holding member 40 and the tubular portions 67 of the first shield case 82 of the first embodiment, but is provided with a chevron-shaped inserting protrusion 92 projecting on the rear surface of a wire holding member 90. The same components as in the first embodiment are denoted by the same reference signs and not described below.

(Shield Case 81)

Figure 17:
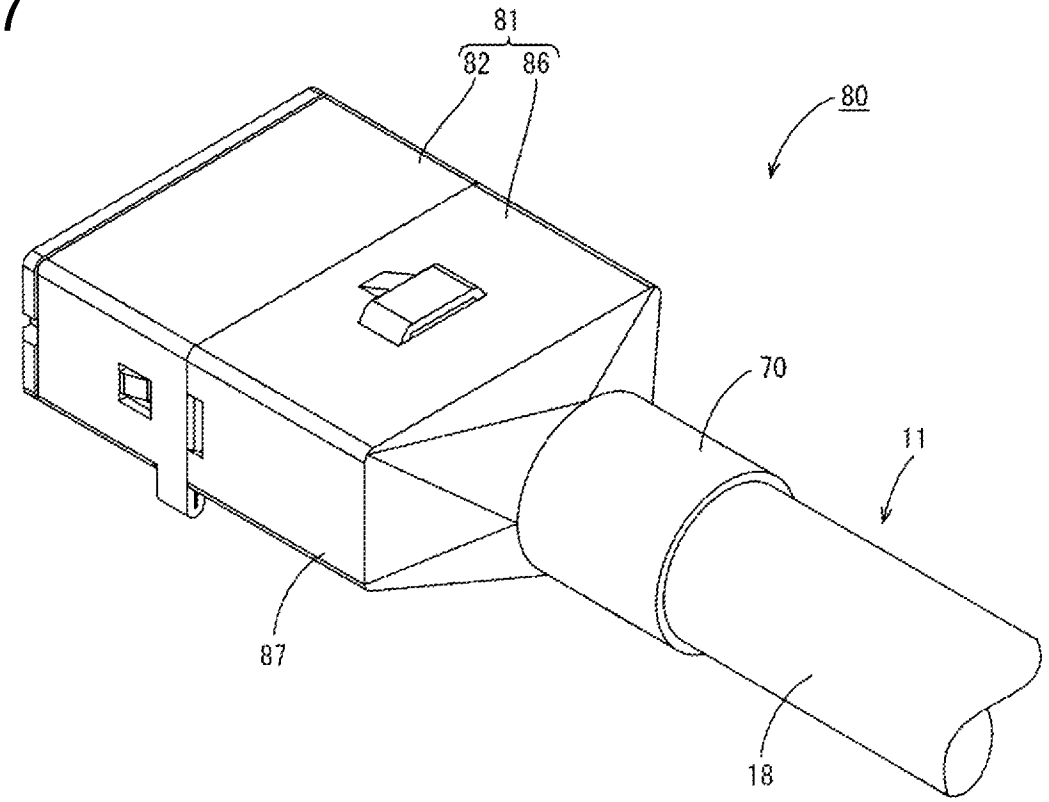
FIG. 17 is a perspective view showing a communication connector of a second embodiment.
Figure 19:
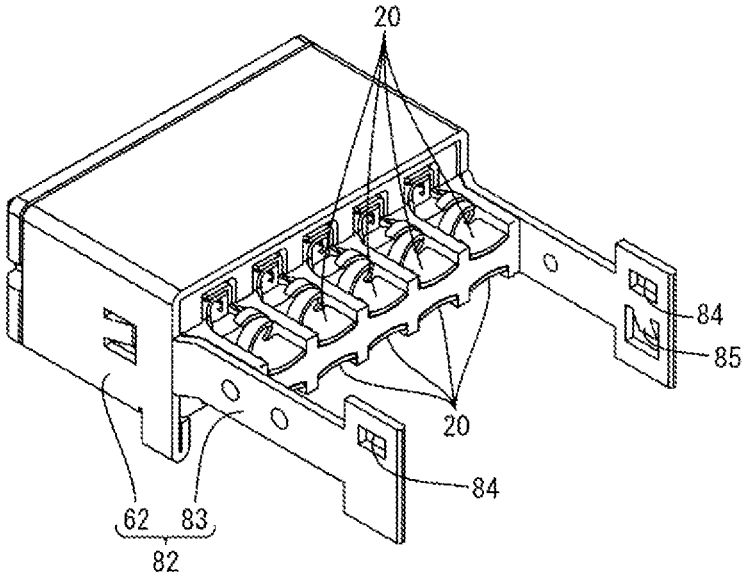
FIG. 19 is a perspective view showing the communication connector in a state where the second shield case and a shielded cable are removed.

The shield case 81 is made of metal, such as aluminum or aluminum alloy, and includes, as shown in FIG. 17, a first shield case 82 for covering a body 31 of a housing 30 and a second shield case 86 arranged behind the first shield case 82 for covering a plurality of wires 12 to 15 (lengths of the wires from an end surface of a filled member 17 are shorter than in the first embodiment). The first shield case 82 includes a housing enclosing portion 62 and left and right shield extending portions 83 extending rearward as shown in FIG. 19.

The shield extending portions 83 are plates extending rearward from the rear ends of side surface parts of the housing enclosing portion 62, and include rectangular penetrating locking holes 84 and connecting pieces 85 configured to resiliently contact the inner surface of the second shield case 86. The connecting pieces 85 are resiliently deformable and electrically connect the first and second shield cases 82, 86.

The second shield case 86 includes a box-shaped wire shielding portion 87 open on a front side and a shield connecting portion 70. The wire shielding portion 87 is shorter than the wire shielding portion 69 of the first embodiment in a front-rear direction and encloses the wires 12 to 15 and the wire holding member 90.

(Wire Holding Member 90)

Figure 24:
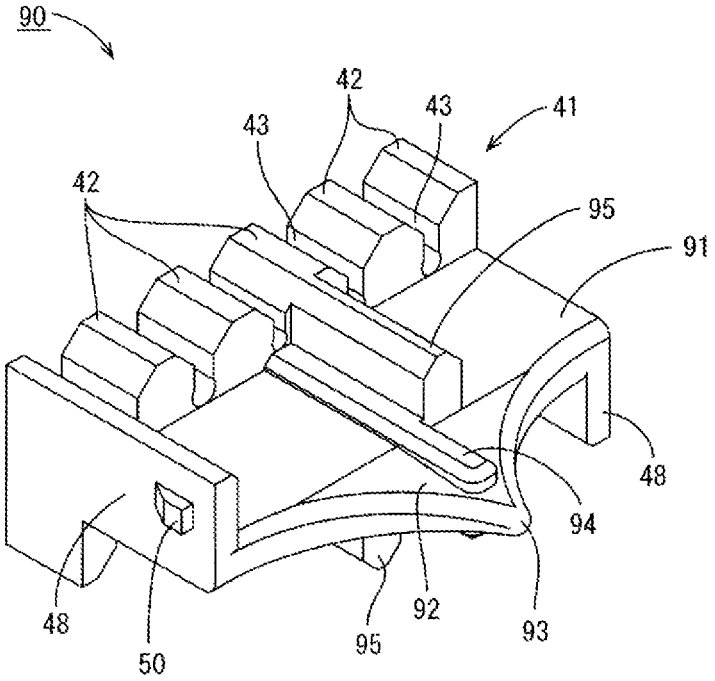
FIG. 24 is a perspective view showing the wire holding member.
Figure 25:
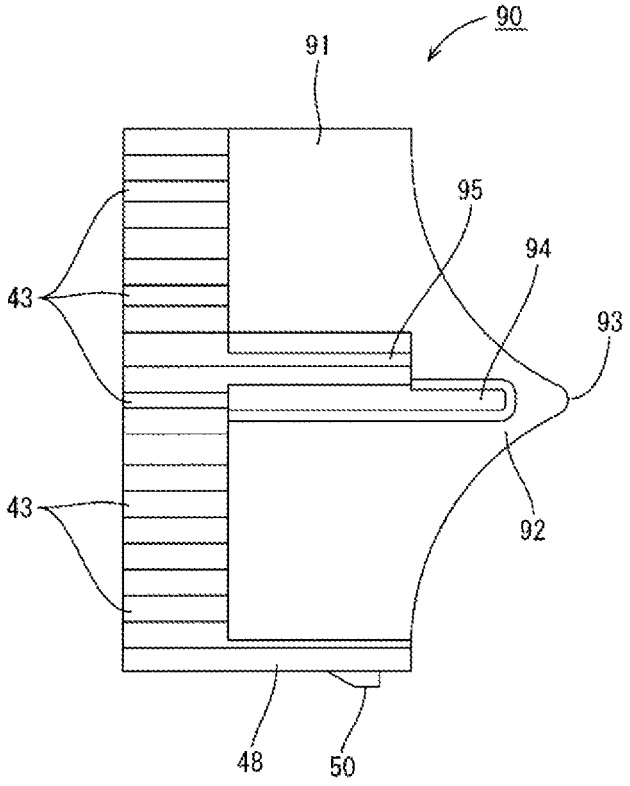
FIG. 25 is a plan view showing the wire holding member.
Figure 26:
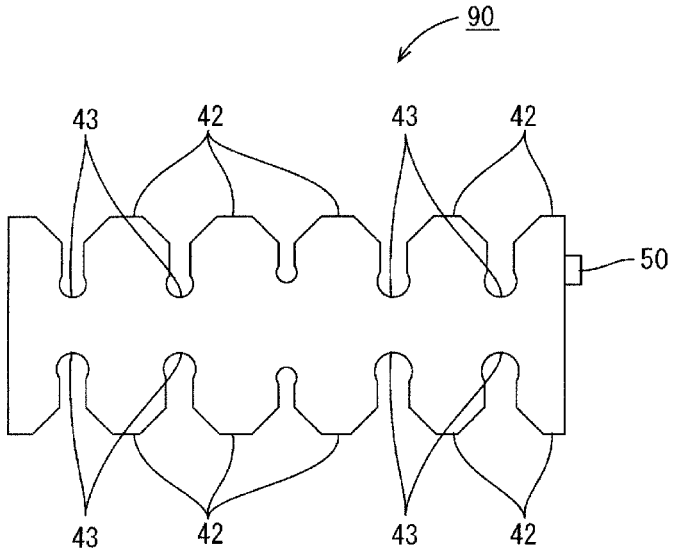
FIG. 26 is a front view showing the wire holding member.
Figure 27:
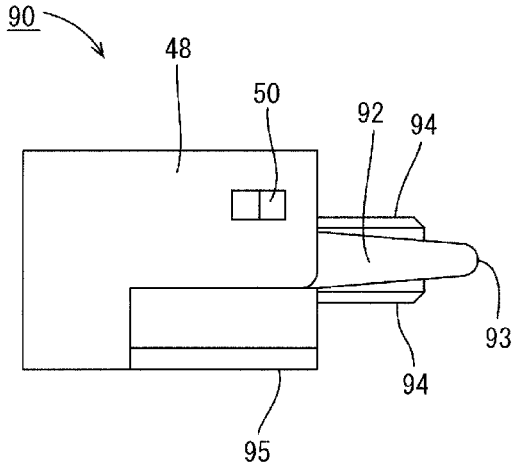
FIG. 27 is a right side view showing the wire holding member.
Figure 28:
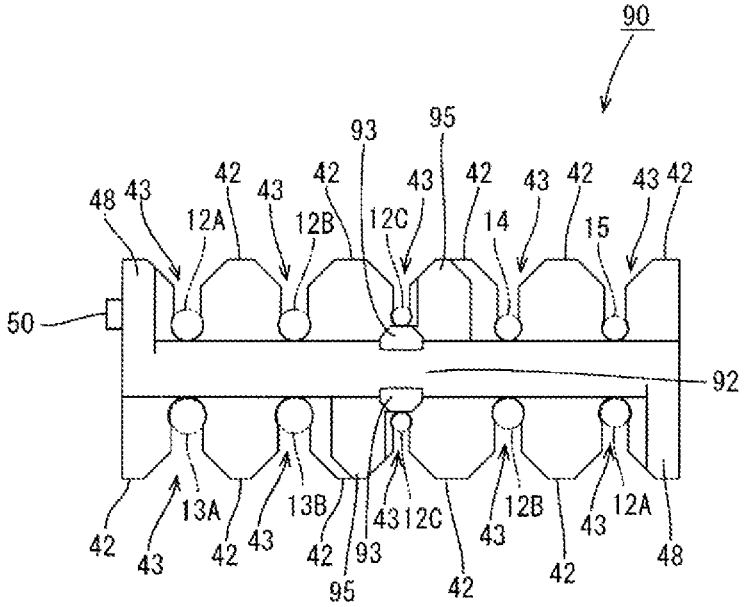
FIG. 28 is a back view showing the wire holding member.

The wire holding member 90 is made of synthetic resin and is arranged at an interval from the rear end of a housing extending portion 35 and includes, as shown in FIGS. 24 and 28, a wire holding portion 41 for arranging and holding a plurality of wires 12 to 15, a plate 91 integrally connected behind the wire holding portion 41, and standing walls 48, 95 standing up and down from the plate 91.

The wire holding portion 41 includes holding protrusions 42 laterally arranged in a row at intervals and projecting up on an upper surface side, and holding protrusions 42 laterally arranged in a row at intervals projecting down on a lower surface side. The plate-like portion 91 includes the chevron-shaped inserting protrusion 92 projecting farther rearward than the standing walls 48, 95.

Figure 23:
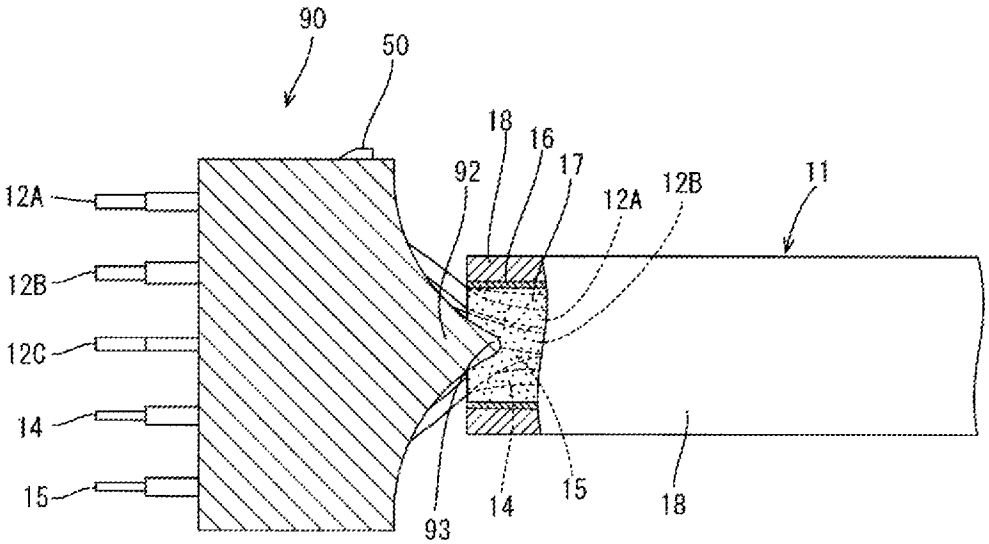
FIG. 23 is a section along C-C of FIG. 22.

The inserting protrusion 92 is formed to gradually reduce a width (lateral dimension) and a thickness (vertical dimension) of the plate 91 toward a rear side, and is inclined to have a curved chevron shape in a plan view. A tip of the inserting protrusion 92 defines a tapered edge 93. When the inserting protrusion 92 is inserted into an end part of the filled member 17, the edge 93 is embedded in the filled member 17, as shown in FIG. 23.

A reinforcing rib 94 is formed on each of upper and lower surfaces of a widthwise intermediate part of the plate 91. The reinforcing rib 94 extends in the front-rear direction from a position behind holding protrusions 42 to the edge 93. A base end part of the standing wall 49 is connected to a lateral side of the reinforcing rib 94. The standing wall 95 differs from the standing wall 49 of the first embodiment only in that the rear end surface is flat.

Figure 18:
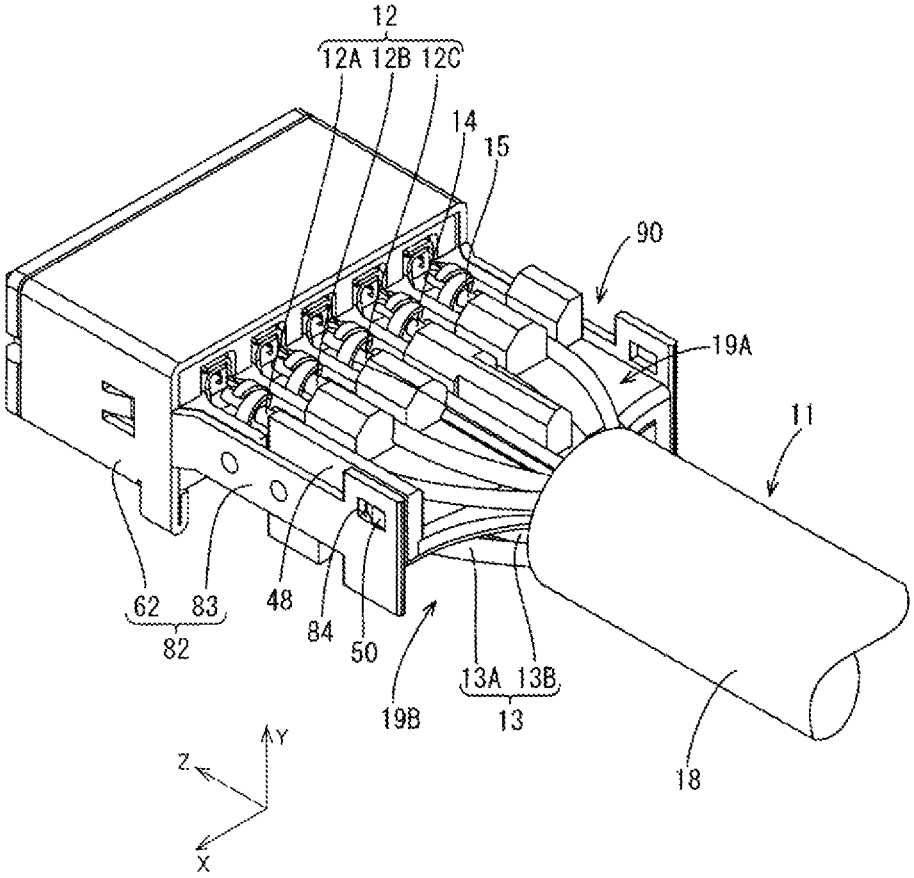
FIG. 18 is a perspective view showing the communication connector in a state where a second shield case is removed.
Figure 20:
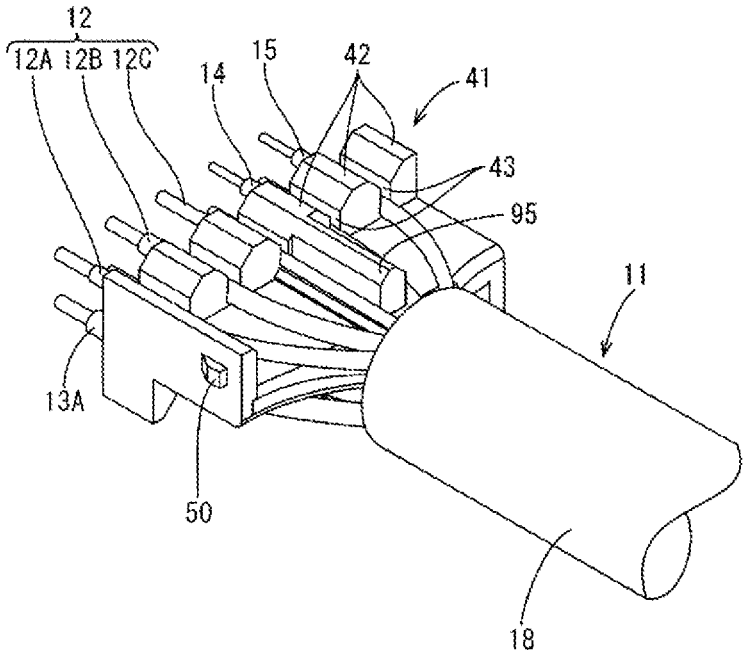
FIG. 20 is a perspective view showing a state where an inserting protrusion of a wire holding member is inserted in a filled member in an end part of a shielded cable.
Figure 21:
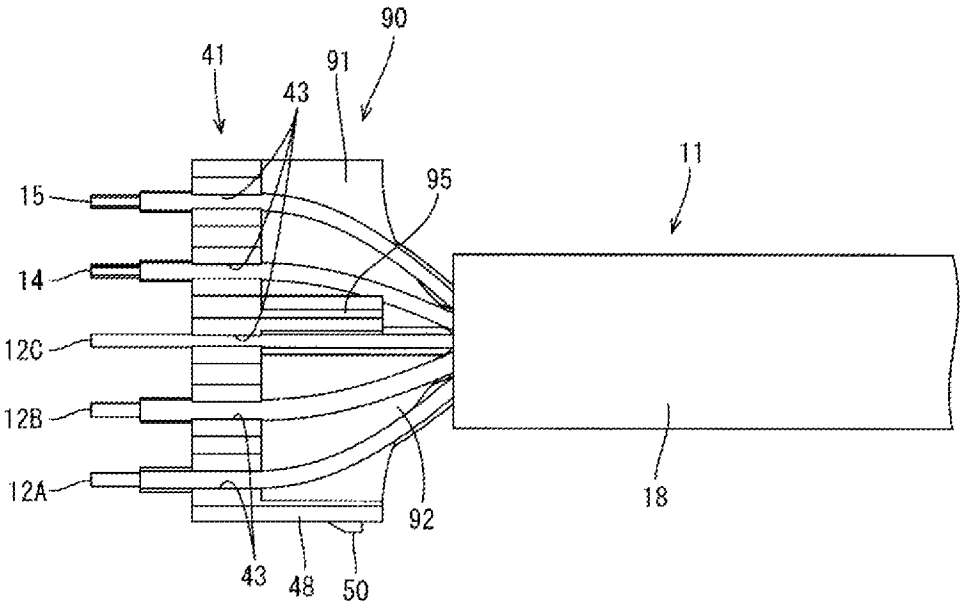
FIG. 21 is a plan view showing the state where the inserting protrusion of the wire holding member is inserted in the filled member in the end part of the shielded cable.
Figure 22:
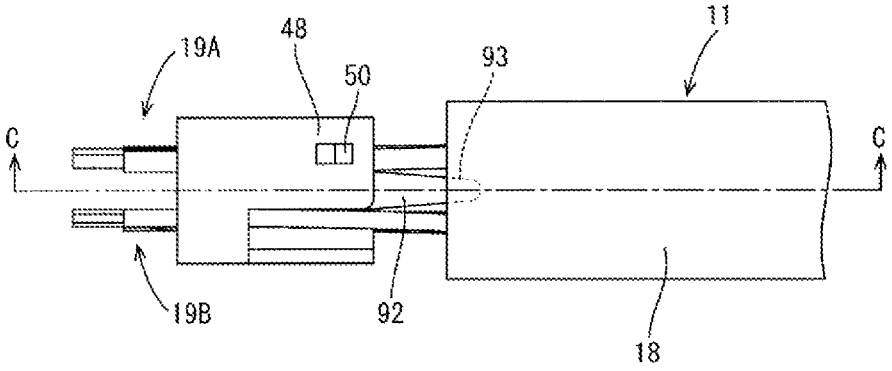
FIG. 22 is a right side view showing the state where the inserting protrusion of the wire holding member is inserted in the filled member in the end part of the shielded cable.

The communication connector 80 is assembled, for example, by mounting the second shield case 86 on a shielded cable 11 and inserting the inserting protrusion 92 of the wire holding member 90 into the end surface of the filled member 17 in the shielded cable 11. Then, the wires 12 to 15 are accommodated into respective wire accommodating portions 45 through respective grooves 43 (FIG. 20). Subsequently, the wire holding member 90 is assembled from behind the first shield case 82 having the housing 30 fit therein (FIG. 18). At this time, conductors of the wires 12 to 15 are arranged at positions to face the terminals 20. Thus, the conductors of the wires 12 to 15 are connected to the terminals 20 by welding, soldering or the like. The communication connector 80 is formed by mounting the second shield case 86 at a predetermined position.

The communication connector 80 of the second embodiment includes the shielded cable 11 having the wires 12 to 15, the filled member 17 to be filled around the wires 12 to 15 and the shield layer 16 enclosing the filled member 17, and the wire holding member 90 holds the wires 12 to 15 exposed form the end part of the filled member 17 and includes the inserting protrusion 92 to be inserted into the end part of the filled member 17.

In this way, the wire holding member 90 can be held at a predetermined position with respect to the shielded cable 11 by inserting the inserting protrusion 92 into the end part of the filled member 17.

A third embodiment is described with reference to FIGS. 29 to 40.

In a communication connector 100 of the third embodiment, wires 12 to 15 are held by two wire holding members 140A, 140B. The same components as in the above embodiments are denoted by the same reference signs and not described below.

(Communication Connector 100)

Figure 29:
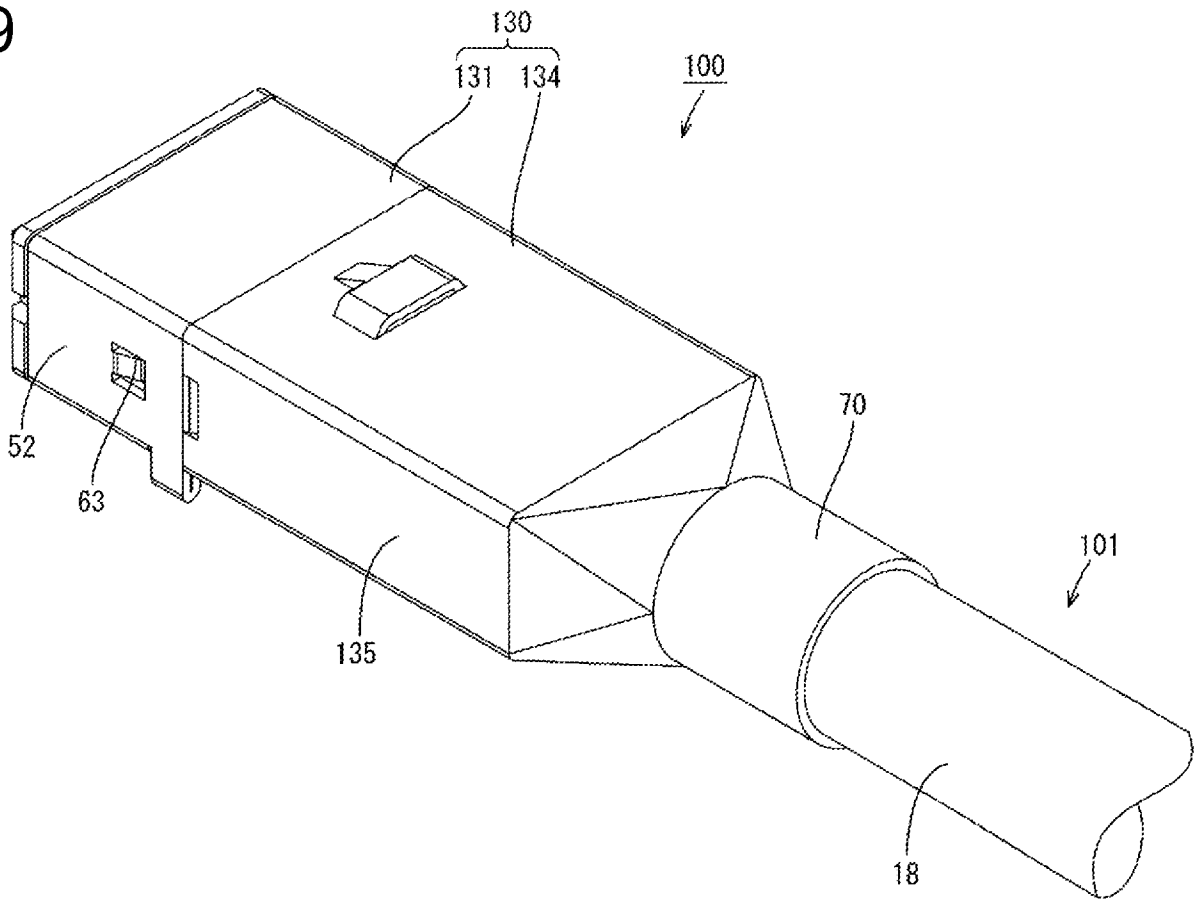
FIG. 29 is a perspective view showing a communication connector of a third embodiment.
Figure 30:
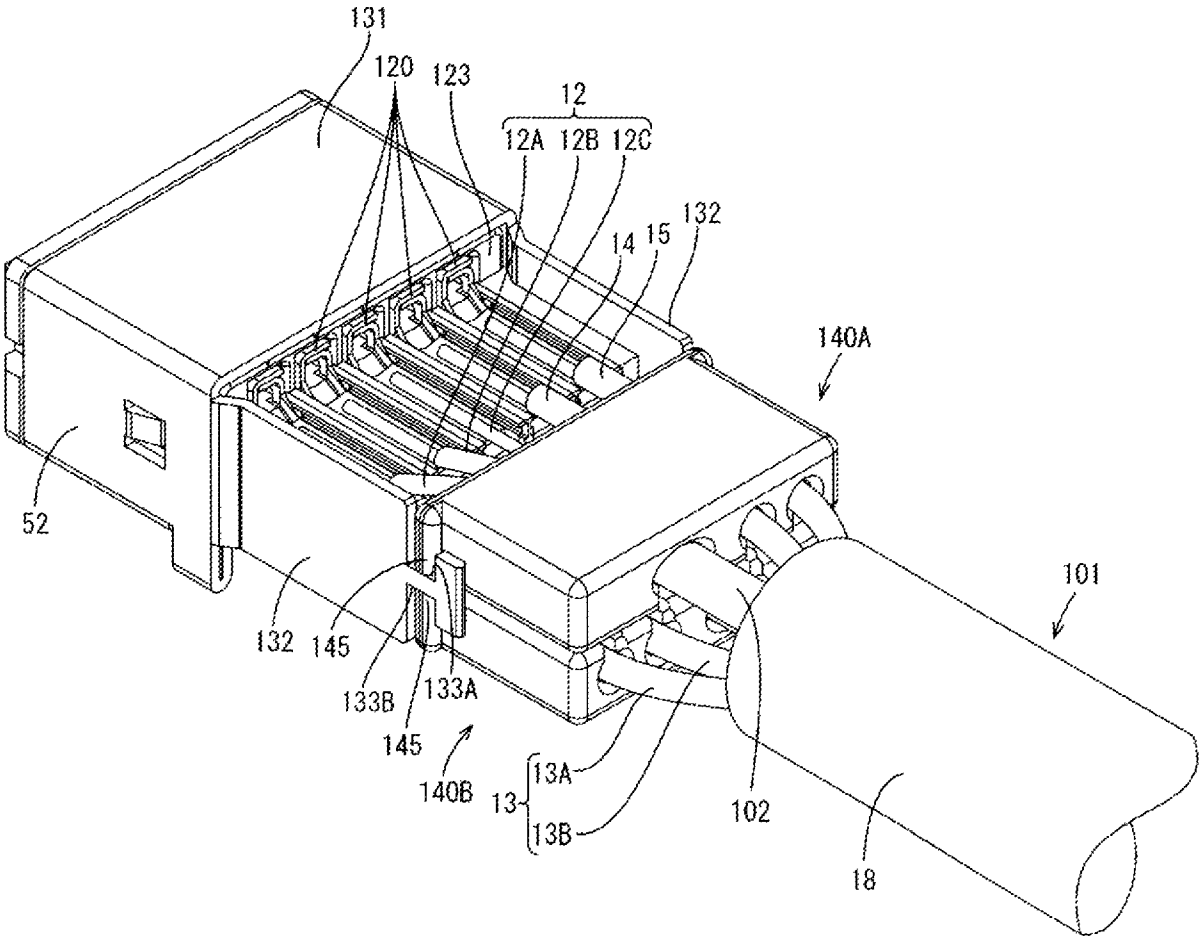
FIG. 30 is a perspective view showing the communication connector in a state where a second shield case is removed.
Figure 31:
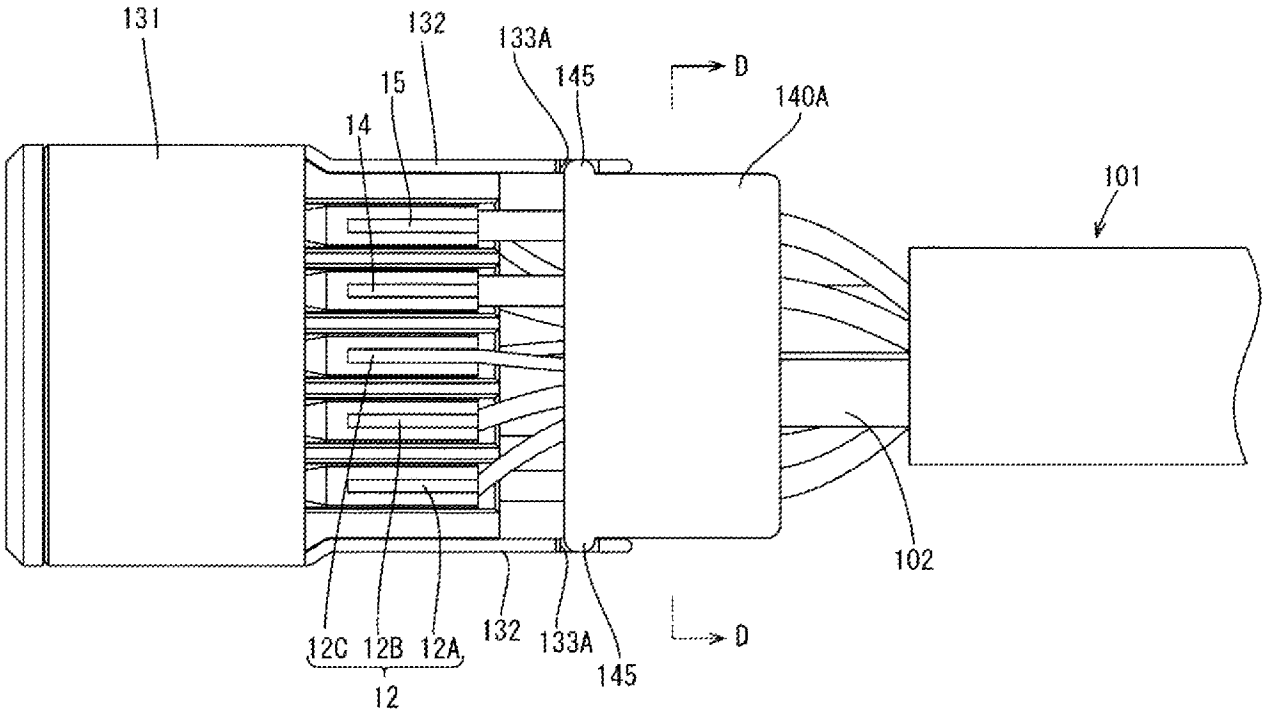
FIG. 31 is a perspective view showing the communication connector in the state where the second shield case is removed.

The communication connector 100 includes, as shown in FIGS. 29 and 30, a shielded cable 101 having wires 12 to 15, terminals 120 connected to end parts of the respective wires 12 to 15, a housing 123 for accommodating the terminals 120, the wire holding members 140A, 140B arranged behind the housing 123, and a shield case 130 for covering the housing 123 and the wire holding members 140A, 140B The shielded cable 101 is a cable capable of high speed communication of 1 GHz or faster and includes ten wires 12 to 15, tubular shield tubes 102 for collectively enclosing three wires 12A to 12C, a filled member 17 (see FIG. 23), a shield layer 16, and an insulation coating 18. At an end part of the shielded cable 101, the filled member 17 and the insulation coating 18 are removed to expose the wires 12 to 15. The shield tube 102 is a shield for the wires 12A to 12C and, in this embodiment, extends forward over a predetermined length from ends of the filled member 17 and the insulation coating 18.

Figure 34:
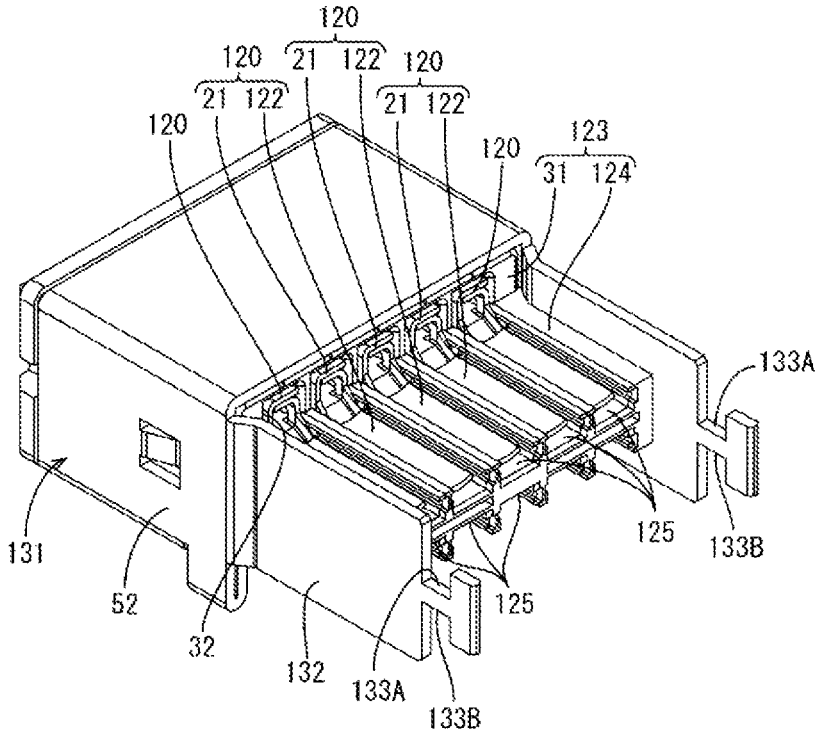
FIG. 34 is a perspective view showing a state where a housing and terminals are mounted in a first shield case.
Figure 35:
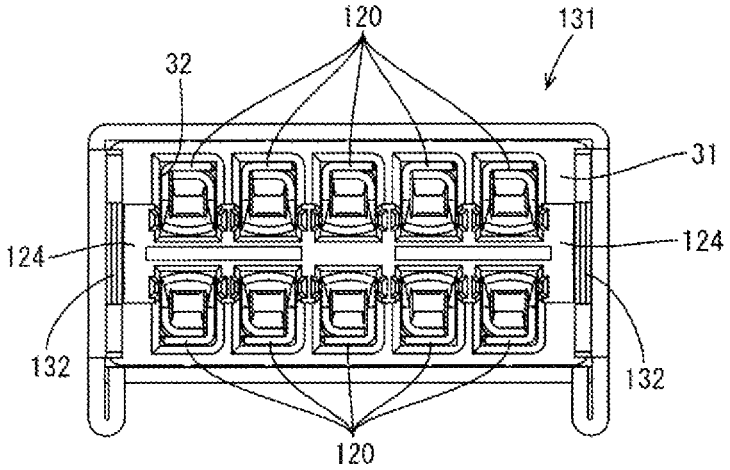
FIG. 35 is a back view showing the state where the housing and the terminals are mounted in the first shield case.
Figure 36:
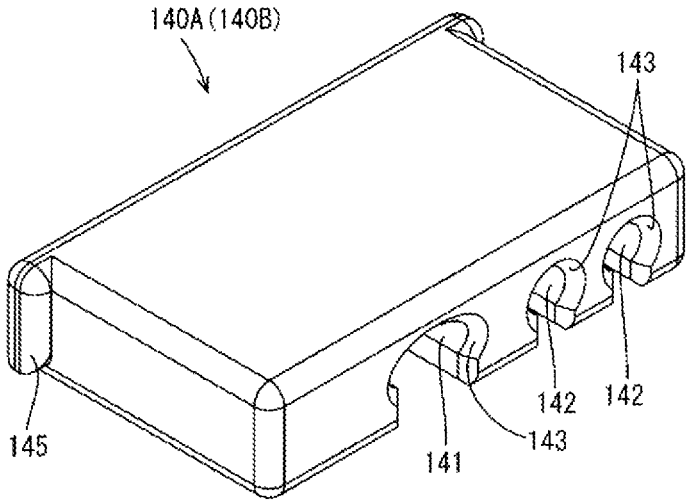
FIG. 36 is a perspective view showing a wire holding member.

As shown in FIG. 34, a front side of the terminal 120 serves as a terminal connecting portion 21 in the form of a rectangular tube, and a plate-like wire connecting portion 122 to be connected to an exposed conductor of the wire 12 to 15 is formed integrally on a rear of the terminal connecting portion 21. The conductor of the wire 12 to 15 is connected to the wire connecting portion 122, for example, by soldering, welding or the like.

The housing 123 is made of insulating synthetic resin and includes a body 31 for accommodating the terminal connecting portions 21 of the respective terminals 120 and an extending portion 124 extending rearward behind the body 31 and having a smaller vertical thickness than the body 31. The extending portion 124 is a plate extending rearward from a vertically middle part on the rear end of the body 31 and includes placing portions 125 arranged such that the wire connecting portions 122 of the respective terminals 120 can be placed thereon. Each placing portion 125 is a shallow groove and includes a bottom surface and groove walls standing from both side edges of the bottom surface. The placing portions 125 are formed side by side in a lateral direction according to the number of the terminals 120 on each of the upper and bottom surfaces of the extending portion 124.

The shield case 130 includes, as shown in FIG. 29, a first shield case 131 for covering the body 31 of the housing 123 and a second shield case 134 arranged behind the first shield case 131 for covering wires 12 to 15. The second shield case 134 includes a box-shaped wire shielding portion 135 open on a front end and a shield connecting portion 70.

The first shield case 131 is made of metal, such as aluminum or aluminum alloy, and includes, as shown in FIG. 30, a housing enclosing portion 52 and shield extending portions 132 extending rearward from side walls of the housing enclosing portion 52. The shield extending portion 132 is a plate extending rearward from the rear end of a side surface part of the housing enclosing portion 52, and has upper and lower sides respectively cut to form upper and lower locking recesses 133A, 133B.

Figure 32:
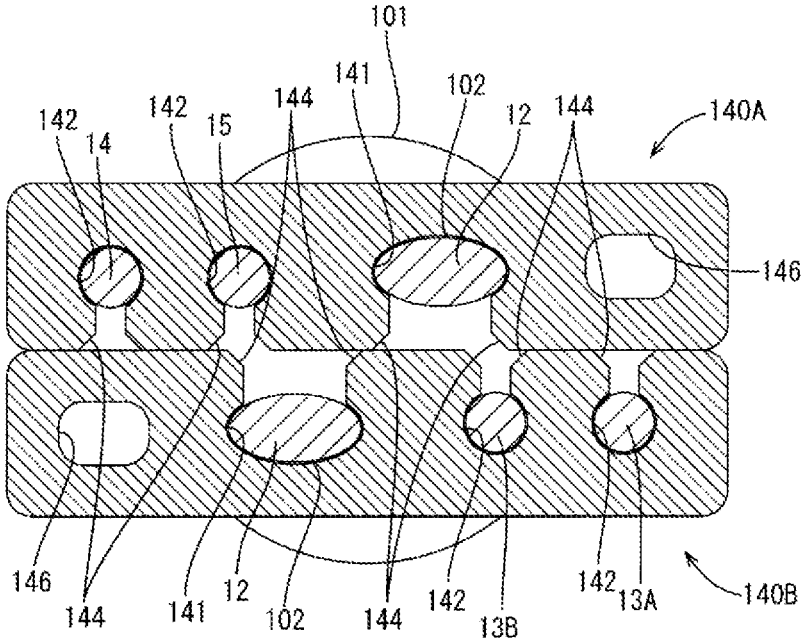
FIG. 32 is a section along D-D of FIG. 31.
Figure 33:
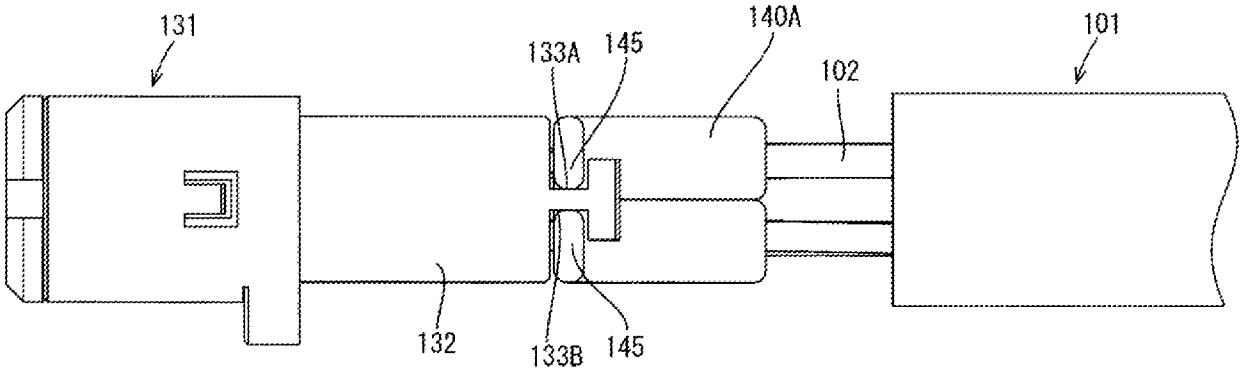
FIG. 33 is a right side view showing the communication connector in the state where the second shield case is removed.

As shown in FIG. 32, the two wire holding members 140A, 140B are identically shaped and a plurality of wire insertion holes 141, 142 laterally arranged at intervals penetrate in the front-rear direction. The shield tube 102 and the wires 12A to 12C inside the shield tube 102 are inserted collectively into one wire insertion hole 141 that has an elliptical shape long in the lateral direction. The wires 13 to 15 are accommodated individually into two wire insertion holes 142 arranged side by side. Each wire insertion hole 141, 142 has substantially the same cross-sectional shape over the entire length in the front-rear direction.

Figure 37:
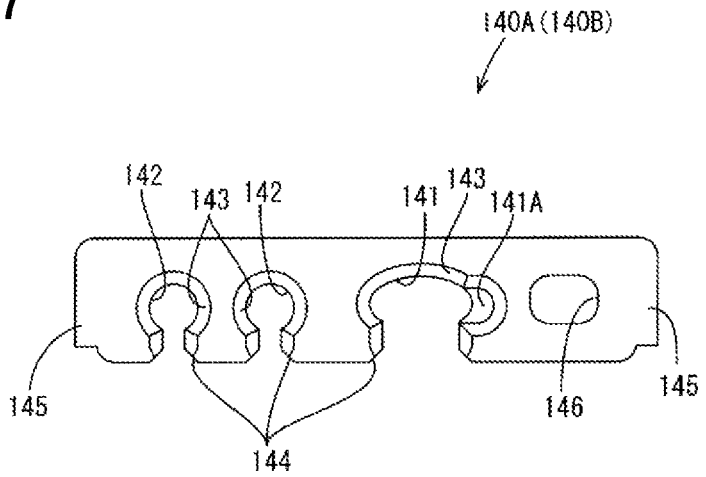
FIG. 37 is a front view showing the wire holding member.
Figure 38:
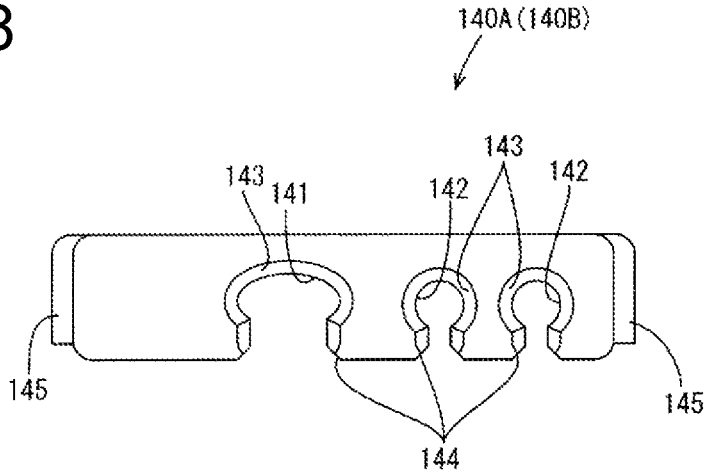
FIG. 38 is a back view showing the wire holding member.
Figure 39:
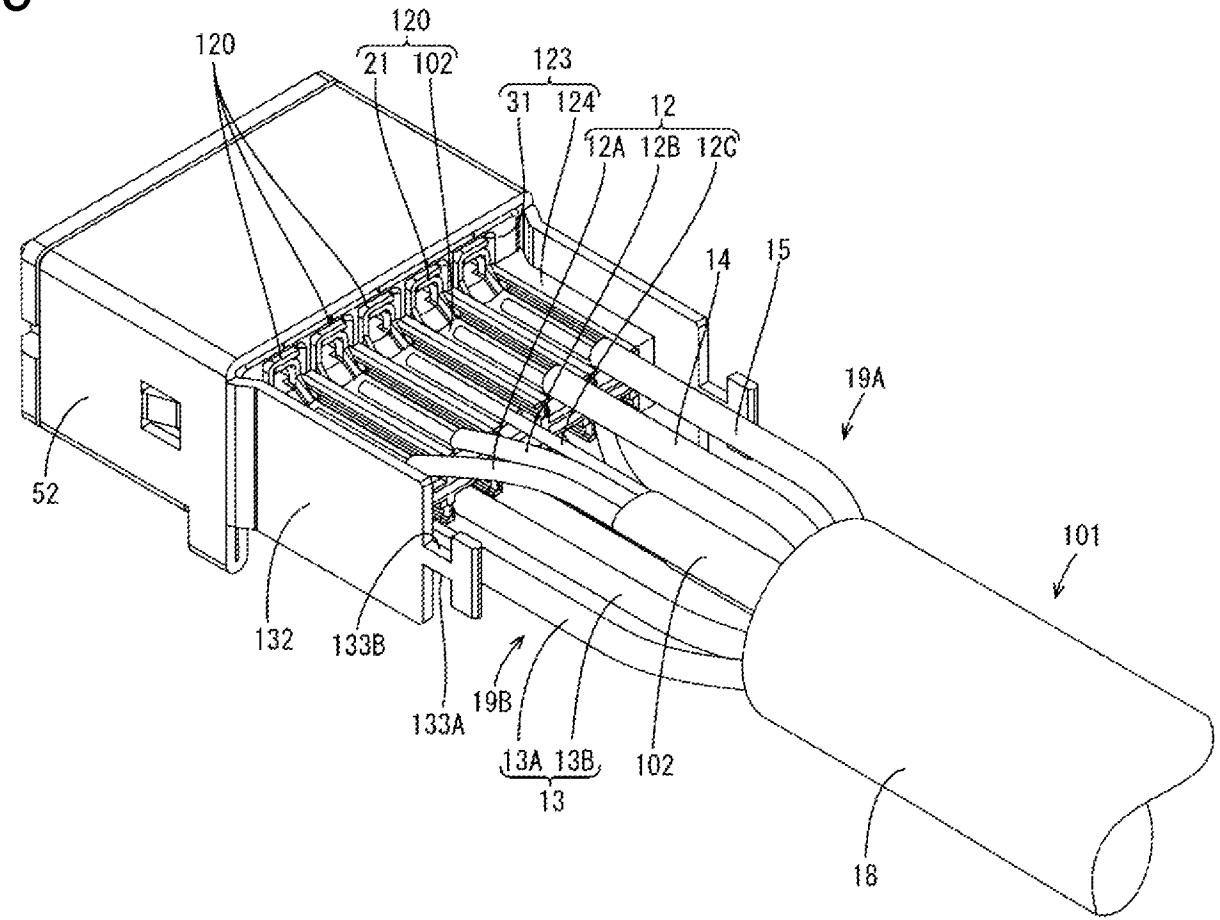
FIG. 39 is a perspective view showing the communication connector in a state where the second shield case and the wire holding member are removed.
Figure 40:
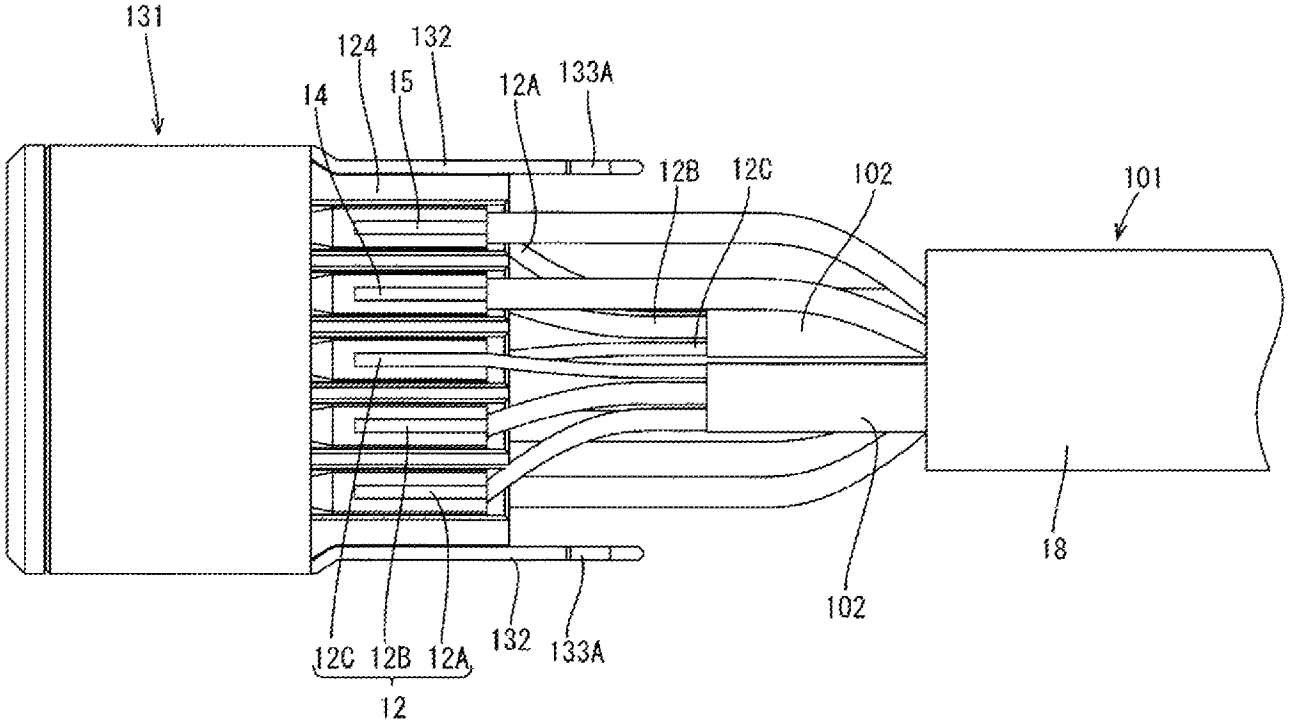
FIG. 40 is a plan view showing the communication connector in the state where the second shield case and the wire holding member are removed.

A guide 141A for guiding a direction of the wire 12A is cut on an opening on a front surface side of the wire insertion hole 141, as shown in FIG. 37. Note that a lightening hole 146 is formed to have a predetermined depth on the front surface of the wire holding member 140A, 140B. Front and rear edges of the wire insertion holes 141, 142 are cut obliquely to form tapers 143. The wire holding member 140A, 140B is formed with through grooves 144 allowing the wire insertion holes 141, 142 to communicate with outside and extending along an axial direction (front-rear direction) of the wire insertion holes 141, 142. Opening edges of the through grooves 144 are widened gradually. The shield tube 102 is held in contact or close contact with (electrically connected if the wire holding member 140A, 140B is conductive) the inner wall of the wire insertion hole 141. Further, the insulation coatings of the respective wires 13 to 15 inserted into the wire insertion holes 142 are held in contact or close contact with the inner walls of the wire insertion holes 142. In this way, the wires 12 to 15 inserted into the wire insertion holes 141, 142 are held at predetermined positions.

Case connecting portions 145 laterally project on front end parts of the side surfaces of the wire holding member 140A, 140B. The case connecting portions 145 are locked to the locking recesses 133A, 133B (if the wire holding member 140A, 140B is conductive, the shield case 130 and the wire holding member 140A, 140B are electrically connected). As shown in FIG. 32, while respectively holding the wires 12 to 15, the wire holding members 140A, 140B are arranged to face each other such that surfaces on the sides where the through grooves 144 are formed are held in close contact with each other.

The wire holding members 140A, 140B can be made, for example, of conductive resin, insulating synthetic resin or metal. If the wire holding members 140A, 140B are conductive, a shielding function can be given. In this case, a shielding property may be given by applying metal plating to a surface of insulating resin or by containing metal in resin.

The wire holding members 140A, 140B may be, for example, mounted on the terminals 120 accommodated in the housing 123 while holding the wires 12 to 15. Further, for example, one wire holding member 140A may be mounted on the first wire row 19A connected to the terminals 120 from above (outside) from a state of FIG. 39, and the other wire holding member 140B may be mounted on the second wire row 19B connected to the terminals 120 from below (outside). Note that the wire holding members 140A, 140B may be shaped differently if they can hold the respective wires 12 to 15.

According to the third embodiment, the communication connector 100 includes the two wire holding members 140A, 140B formed with the penetrating wire insertion holes 141, 142 into which the wires 12 to 15 are to be inserted, and the two wire holding members 140A, 140B are formed with the through grooves 144 enabling the wires 12 to 15 to be passed laterally with respect to an axial direction of the wire insertion holes 141, 142.

Since the wire holding members 140A, 140B can hold the wires 12 to 15 inserted into the wire insertion holes 141, 142 through the through grooves 144 laterally with respect to the axial direction of the wire insertion holes 141, 142 in this way, an operation of removing the coatings of the wires 12 to 15 and an operation of mounting the wires 12 to 15 into the housing 123 can be performed easily with the wires 12 to 15 held by the wire holding members 140A, 140B, whereby assembling operability can be improved.

The invention is not limited to the above described and illustrated embodiments. For example, the following embodiments also are included in the scope of the invention.

The number of the wires 12 to 15 is not limited to the number described above. The numbers of the holding protrusions 42 and the grooves 43 can also be appropriately changed according to the number of the wires 12 to 15.

Although the wires 12 to 15 are press-fit into the grooves 43, there is no limitation to this. For example, clearances may be provided between the wires 12 to 15 and the grooves. Further, without limitation to the configuration for inserting the wires 12 to 15 into the grooves 43, the wires 12 to 15 may be held at predetermined positions, for example, by providing the wire holding member 40 with a configuration for pressing the wires 12 to 15.

Although the shield extending portions 64 are provided with the tubular portions 67 and the restricting portions 51 of the wire holding member 40 are inserted through the tubular portions 67 in the first embodiment, there is no limitation to this. For example, the wire holding member may be provided with the tubular portions and the shield extending portions may be configured to be inserted into the tubular portions.

LIST OF REFERENCE SIGNS

10, 80, 100: communication connector
11, 101: shielded cable
12 to 15: wire
16: shield layer
17: filled member
18: insulation coating
19A: first wire row
19B: second wire row
20, 120: terminal
30, 123: housing
32: cavity
40, 90, 140A, 140B: wire holding member
41: wire holding portion
42: holding protrusion
43: groove
47, 91: portioning plate
49, 95: standing wall (partitioning portion)
51: restricting portion
60, 81, 130: shield case
64, 83, 132: shield extending portion (extending portion)
67: tubular portion
92: inserting protrusion
93: edge
141, 142: wire insertion hole
144: through groove

The invention claimed is:

1. A communication connector, comprising:

a plurality of wires including first communication wires for transmitting communication signals at a first transfer speed, a second communication wire for transmitting communication signals at a second transfer speed that is different from the first transfer speed and a power supply wire;

a plurality of terminals to be connected to the respective wires;

a housing for accommodating the plurality of terminals in first and second rows at least one wire holding member disposed rearward of an adjacent to the housing and configured for arranging and holding the plurality of wires in first and second rows at intervals corresponding to the terminals accommodated in the housing, the first row including first grooves configured for holding and pinching a first plurality of the first communication wires and the power supply wire and the second wire row including second grooves configured for holding and pinching a second plurality of first communication wires and the second communication wire, the wire holding member holding the first and second wire rows in parallel, and the first plurality of first communication wires of the first wire row and the second plurality of first communication wires of the second wire row are arranged in areas distant from each other; and a shield case including a body covering the housing and an extending portion extending rearward of the housing and engaging the wire holding portion for restricting rearward movement of the wire holding portion away from the housing.

2. A communication connector, comprising:

a housing having opposite front and rear ends and first and second rows of cavities, the cavities extending through the housing from the rear end to the front end;

a shielded cable that includes wires, a filled member to be filled around the wires and a shield layer enclosing the filled member;

terminals connected respectively to the wires and inserted respectively in the cavities; and first and second wire holding members having front ends mounted at the rear end of the housing and rear ends opposite the front end, the first wire holding member being formed with first grooves extending from the front end to the rear end and substantially aligned with the cavities in the first row of cavities and the second wire holding member being formed with second grooves extending from the front end to the rear end and substantially aligned with the cavities in the second row of cavities, the grooves being configured to hold a respective one of the wires exposed from an end part of the filled member, the wire holding members being oriented so that the first grooves are open on a side of the first wire holding member facing the second wire holding member and the second grooves are open on a side of the second wire holding member facing toward the first wire holding member.

3. The communication connector of claim 2, wherein the grooves are configured for enabling the wires to be passed laterally with respect to an axial direction of the wires.

4. The communication connector of claim 3, wherein:

each of the wire holding members includes partitions between the grooves, the partitions of the first wire holding member being at least partly aligned with the grooves of the second wire holding member and the partitions of the second wire holding member being at least partly aligned with the grooves of the first wire holding member.

5. The communication connector of claim 1, the at least one wire holding member includes first and second wire holding members, the first grooves being open on a side of the first wire holding member facing the second wire holding member and the second grooves being open on a side of the second wire holding member facing toward the first wire holding member, the first and second grooves enabling the wires to be passed laterally with respect to an axial direction of the wire.

6. The communication connector of claim 1, wherein:

the wire holding member includes a partitioning portion for partitioning between the first communication wires or between the first communication wire and the power supply wire.

7. The communication connector of claim 1, wherein the housing includes a plurality of cavities for accommodating the respective terminals and is mounted in a vehicle.

8. The communication connector of claim 1, wherein the wires are part of a shielded cable that includes wires, a filled member to be filled around the wires and a shield layer enclosing the filled member, and wherein the wire holding member includes an inserting protrusion to be inserted into the end part of the filled member.

9. The communication connector of claim 2, further comprising a shield case including a body covering the housing and an extending portion extending rearward of the housing and engaging the wire holding portions for restricting movement of the wire holding portion rights relative to the housing.

10. The communication connector of claim 2, wherein each of the wire holding portions includes partitions adjacent to each of the grooves, the partitions of the first wire holding member at least partly closing the grooves in the second wire holding member, and the partitions of the second wire holding member at least partly closing the grooves of the first wire holding member.

11. The communication connector of claim 10, the first and second wire holding members are identically configured.

12. A communication connector, comprising:

a housing having opposite front and rear ends and first and second rows of cavities, the cavities extending through the housing from the rear end to the front end;

wires;

terminals connected respectively to the wires and inserted respectively in the cavities;

first and second wire holding members having front ends mounted at the rear end of the housing and rear ends opposite the front end, the first wire holding member being formed with first grooves extending from the front end to the rear end and substantially aligned with the cavities in the first row of cavities and the second wire holding member being formed with second grooves extending from the front end to the rear end and substantially aligned with the cavities in the second row of cavities, the grooves being configured to hold a respective one of the wires, the wire holding members being oriented so that the first grooves are open on a side of the first wire holding member facing the second wire holding member and the second grooves are open on a side of the second wire holding member facing toward the first wire holding member.

13. The communication connector of claim 12, further comprising a shield case including a body covering the housing and an extending portion extending rearward of the housing and engaging the wire holding portions for restricting rearward movement of the wire holding portion away from the housing.

14. The communication connector of claim 12, wherein each of the wire holding portions includes partitions adjacent to each of the grooves, the partitions of the first wire holding member at least partly closing the grooves in the second wire holding member, and the partitions of the second wire holding member at least partly closing the grooves of the first wire holding member.

* * * * *